US012507862B2

(12) United States Patent
Büsing et al.

(10) Patent No.: US 12,507,862 B2
(45) Date of Patent: Dec. 30, 2025

(54) DISHWASHER

(71) Applicant: SAMSUNG ELECTRONICS CO., LTD., Suwon-si (KR)

(72) Inventors: Johannes Büsing, Suwon-si (KR); Jongwook Kwon, Suwon-si (KR); Kyuha Lee, Suwon-si (KR); Changhyun Kim, Suwon-si (KR); Sungsan Kim, Suwon-si (KR); Joowan Nam, Suwon-si (KR); Woojin Shin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 371 days.

(21) Appl. No.: 18/076,708

(22) Filed: Dec. 7, 2022

(65) Prior Publication Data

US 2023/0180993 A1 Jun. 15, 2023

Related U.S. Application Data

(63) Continuation of application No. PCT/KR2022/013409, filed on Sep. 7, 2022.

(30) Foreign Application Priority Data

Dec. 14, 2021 (KR) ..... 10-2021-0178633

(51) Int. Cl.
*A47L 15/48* (2006.01)
*A47L 15/42* (2006.01)
*A47L 15/50* (2006.01)

(52) U.S. Cl.
CPC ..... *A47L 15/486* (2013.01); *A47L 15/4287* (2013.01); *A47L 15/507* (2013.01)

(58) Field of Classification Search
CPC ... A47L 15/486; A47L 15/4287; A47L 15/507
(Continued)

(56) References Cited

U.S. PATENT DOCUMENTS 9,635,997 B2 5/2017 Lee et al.

FOREIGN PATENT DOCUMENTS

CN 105832270 A 8/2016
CN 105919534 A 9/2016
(Continued)

OTHER PUBLICATIONS

CN209996270U—machine translation (Year: 2020).*
(Continued)

*Primary Examiner* — Tinsae B Ayalew
(74) *Attorney, Agent, or Firm* — STAAS & HALSEY LLP

(57) ABSTRACT

A dishwasher includes: a tub including a washing room; and a dryer installed on one side of the tub, the dryer including: a first housing coupled with the tub and communicating with the washing room; a second housing coupled with an other side of the first housing, and forming a flow path together with the first housing so that inside air of the washing room circulates back to the washing room by passing through the flow path; a heater accommodated inside the first housing and the second housing to heat the air passing through the flow path; and a switch module positioned upstream of the heater, configured to detect an inside temperature of the flow path to turn on or off the heater based on the detected inside temperature, and fixed between the first housing and the second housing by coupling of the first housing with the second housing.

19 Claims, 19 Drawing Sheets

(58) Field of Classification Search
USPC ..... 134/56 D
See application file for complete search history.

(56) References Cited

FOREIGN PATENT DOCUMENTS

| | | | |
|---|---|---|---|
| CN | 108392162 | A | 8/2018 |
| CN | 108577768 | A | 9/2018 |
| CN | 108742458 | A | 11/2018 |
| CN | 109846439 | A | 6/2019 |
| CN | 208973770 | U | 6/2019 |
| CN | 209996270 | U | 1/2020 |
| CN | 210249766 | U | 4/2020 |
| CN | 111728568 | A | 10/2020 |
| CN | 112220421 | A | 1/2021 |
| CN | 112656340 | A | 4/2021 |
| DE | 10 2012 202 738 | A1 | 8/2013 |
| EP | 3 741 286 | A1 | 11/2020 |
| JP | 8-24196 | | 1/1996 |
| JP | 10-117991 | | 5/1998 |
| JP | 2019-80603 | | 5/2019 |
| JP | 2020-58461 | | 4/2020 |
| KR | 20-1996-0004222 | | 5/1996 |
| KR | 97-53505 | | 10/1997 |
| KR | 10-0930566 | | 12/2009 |
| KR | 10-2015-0100435 | | 9/2015 |
| KR | 10-1792513 | | 11/2017 |
| KR | 10-2005442 | | 7/2019 |
| KR | 10-2022-0143296 | | 10/2022 |
| WO | WO 2017/018696 | A1 | 2/2017 |

OTHER PUBLICATIONS

DE102012202738A1—machine translation (Year: 2012).*
CN105919534A—machine translation (Year: 2016).*
CN108742458A—machine translation (Year: 2018).*
International Search Report dated Dec. 28, 2022 issued in PCT Application No. PCT/KR2022/013409.
Written Opinion dated Dec. 28, 2022 issued in PCT Application No. PCT/KR2022/013409.
Supplementary European Search Report dated Sep. 19, 2024 issued in European Application No. EP 22 90 7621.

* cited by examiner

DISHWASHER

CROSS-REFERENCE TO RELATED APPLICATION

This application a continuation application, under 35 U.S.C. § 111(a), of International Application No. PCT/KR2022/013409, filed Sep. 7, 2022, which is based on and claims priority under 35 U.S.C. § 119 to Korean Patent Application No. 10-2021-0178633, filed on Dec. 14, 2021 in the Korean Intellectual Property Office, the disclosure of which is incorporated by reference herein in its entirety.

BACKGROUND

1. Field

The disclosure relates to a dishwasher, and more particularly, to a dishwasher having a dryer with an improved structure.

2. Description of the Related Art

In general, a dishwasher is an apparatus for spraying washing water at high pressure onto dishes accommodated therein to wash the dishes and drying the dishes. The dishwasher operates in such a way as to spray washing water at high pressure into the washing room accommodating dishes to cause the sprayed washing water to reach the dishes and thereby wash off foreign materials such as leftovers remaining on the surfaces of the dishes.

More specifically, the dishwasher includes a washing operation, a rinsing operation, and a drying operation. During the drying operation, water remaining on dishes is evaporated, which may remain condensed water on the side walls of the tub. By using heated air for a drying operation, a quick drying effect is obtained in addition to a sterilizing effect.

To heat air, a heater is used, and to blow air heated by the heater to the washing room, a fan is used.

However, overheating of the heater results in damage of components of the dishwasher, located around the heater. Accordingly, there is a demand for preventing such damage upon use of a heater.

SUMMARY

Therefore, it is an aspect of the disclosure to provide a dishwasher having a dryer with an improved structure.

Additional aspects of the disclosure will be set forth in part in the description which follows and, in part, will be obvious from the description, or may be learned by practice of the disclosure.

In accordance with a concept of the disclosure, a dishwasher includes: a tub including a washing room formed therein; and a dryer installed on one side of the tub, wherein the dryer comprising: a first housing having one side coupled with the one side of the tub and communicating with the washing room; a second housing coupled with an other side of the first housing, and forming a flow path together with the first housing so that inside air of the washing room circulates back to the washing room by passing through the flow path; a heater accommodated inside the first housing and the second housing to heat the air passing through the flow path; and a switch module positioned upstream of the heater, configured to detect an inside temperature of the flow path to turn on or off the heater based on the detected inside temperature, and fixed between the first housing and the second housing by coupling of the first housing with the second housing.

The dryer may further include: an inlet which is formed in the one side of the first housing and through which the inside air of the washing room enters the dryer; and an outlet which is formed in the one side of the first housing and through which air is charged to the washing room, the outlet positioned in a front direction of the dishwasher from the inlet.

The dishwasher may further include a plurality of baskets to be positioned at different heights inside the washing room and being withdrawable in the front direction, the one side of the tub is an outer side of the tub, and the dryer may be installed on the outer side of the tub, the inlet and the outlet of the dryer are positioned between the plurality of baskets.

The first housing may include: a first housing body positioned side by side with the one side of the tub; and a first side flange bent from the first housing body, extending toward the second housing, and including a first switch installing portion in which the switch module is accommodated, and the second housing may include: a second housing body facing the first housing body; and a second side flange bent from the second housing body, extending toward the first housing, and including a second switch installing portion in which the switch module is accommodated.

The first housing may further include a first support rib protruding from an inner surface of the first housing body and supporting the switch module from below, and the second housing may further include a second support rib protruding from an inner surface of the second housing body and supporting the switch module from below.

The switch module may be fixed by being positioned on an upper surface of the first support rib and an upper surface of the second support rib and between the first switch installing portion and the second switch installing portion.

Each of the first support rib and the second support rib may include a chamfer portion formed on an upper surface of the each of the first support rib and the second support rib and inclined downward toward an end of the each of the first support rib and the second support rib.

The switch module may include: a switch configured to turn on or off the heater in response to the detected inside temperature reaching a preset temperature; a holder supported by the first housing and the second housing, the holder accommodating a portion of the switch is accommodated in the holder; and a sealing member positioned between the switch and the holder and sealing the flow path.

The switch may include: a terminal passing through the sealing member and electrically connected with the heater outside the first housing and the second housing; a sensor passing through the holder inside the first housing and inside the second housing and configured to detect the inside temperature of the flow path; and a fixing portion extending from the sensor to be positioned side by side with the holder, and accommodated between the sealing member and the holder.

The first housing may include an outlet through which the air heated by the heater is discharged to the washing room, and the second housing may include a blocking rib formed downstream of the heater and preventing water of the washing room from entering the heater through the outlet, the blocking rib protruding from the inner surface of the second housing.

The blocking rib may include: a moving portion extending upward and curved along a flow direction of a fluid flowing through the flow path; a blocking portion including a blocking surface formed on a lower portion of the moving portion toward the outlet; and a blocking protrusion extending downward from one end of the blocking portion.

A length of the blocking rib protruding from the inner surface of the second housing may be shorter than a length between the inner surface of the second housing and the inner surface of the first housing.

The dishwasher may further include a cabinet positioned outside the tub. The dryer may be installed a space formed between the tub and the cabinet, and a portion of the switch module may be positioned between the tub and the cabinet and exposed upward from the dryer.

The switch module may be electrically connected with the heater through the portion of the switch module which is exposed.

The first housing and the second housing may extend in a front-rear direction of the tub, and inclined downward with respect to a front direction of the dishwasher to discharge water collected inside the first housing and the second housing.

In accordance with another concept of the disclosure, a dishwasher includes: a tub including a washing room formed therein, an inlet port, and an outlet port; a door to open or close the washing room; and a dryer installed on one side of the tub, wherein the dryer includes: a housing having a flow path formed therein, an inlet formed one side of the housing, which communicates with the inlet port of the tub and through which air inside of the washing room enters the dryer; a heater configured to heat the air entered the dryer through the inlet; and an outlet formed on the one side of the housing, which communicates with the outlet port of the tub and through which the air heated by the heater is discharged to the washing room. The housing may be installed on the tub along a front-rear direction of the tub such that the outlet is closer to the door than the inlet.

The dishwasher may further include a plurality of baskets to be positioned at different heights inside the washing room and being withdrawable in a front direction of the dishwasher, and the dryer may be installed on an outer side of the tub, and the inlet and the outlet of the dryer are positioned between the plurality of baskets.

The housing may include: a first housing coupled with the tub and communicating with the washing room; and a second housing forming the flow path together with the first housing and positioned on an outer side of the first housing so that inside air of the washing room circulates back to the washing room by passing through the flow path, and the dryer may include: a heater accommodated inside the first housing and the second housing; and a switch module installed between the first housing and the second housing and configured to turn on or off the heater.

In accordance with another concept of the disclosure, a dishwasher includes: a cabinet; a tub inside the cabinet and forming a washing room therein; and a dryer between the cabinet and the tub and configured to heat air inside of the washing room, wherein the dryer includes: a first housing coupled with a side wall of the tub; a second housing coupled with the first housing and forming a flow path together with the first housing; a heater installed between the first housing and the second housing to heat the air passing through the flow path; and a switch module supported by coupling the first housing with the second housing, wherein a portion of the switch module is exposed to a space formed between the tub and the cabinet, and electrically connected with the heater through the portion of the switch module which is exposed.

A lower surface of the switch module may be supported by a first support rib and a second support rib positioned upstream of the heater, protruding toward the flow path, and extending respectively from inner surfaces of the first housing and the second housing.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
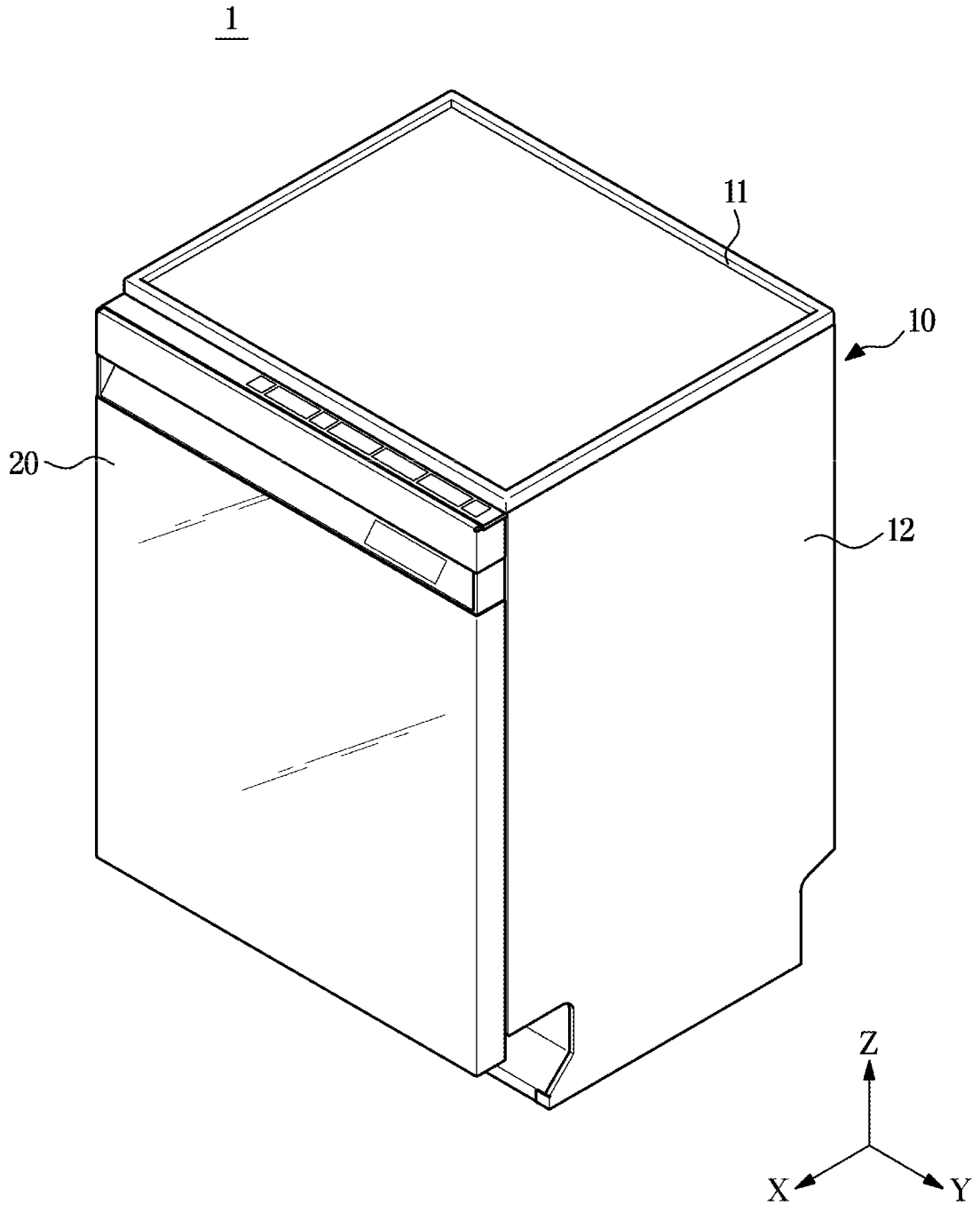
FIG. 1 is a perspective view showing a dishwasher according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "including" or "having," etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Throughout the disclosure, the expression "at least one of a, b or c" indicates only a, only b, only c, both a and b, both a and c, both b and c, all of a, b, and c, or variations thereof.

Hereinafter, the embodiments of the disclosure will be described in detail with reference to the accompanying drawings.

Figure 2:
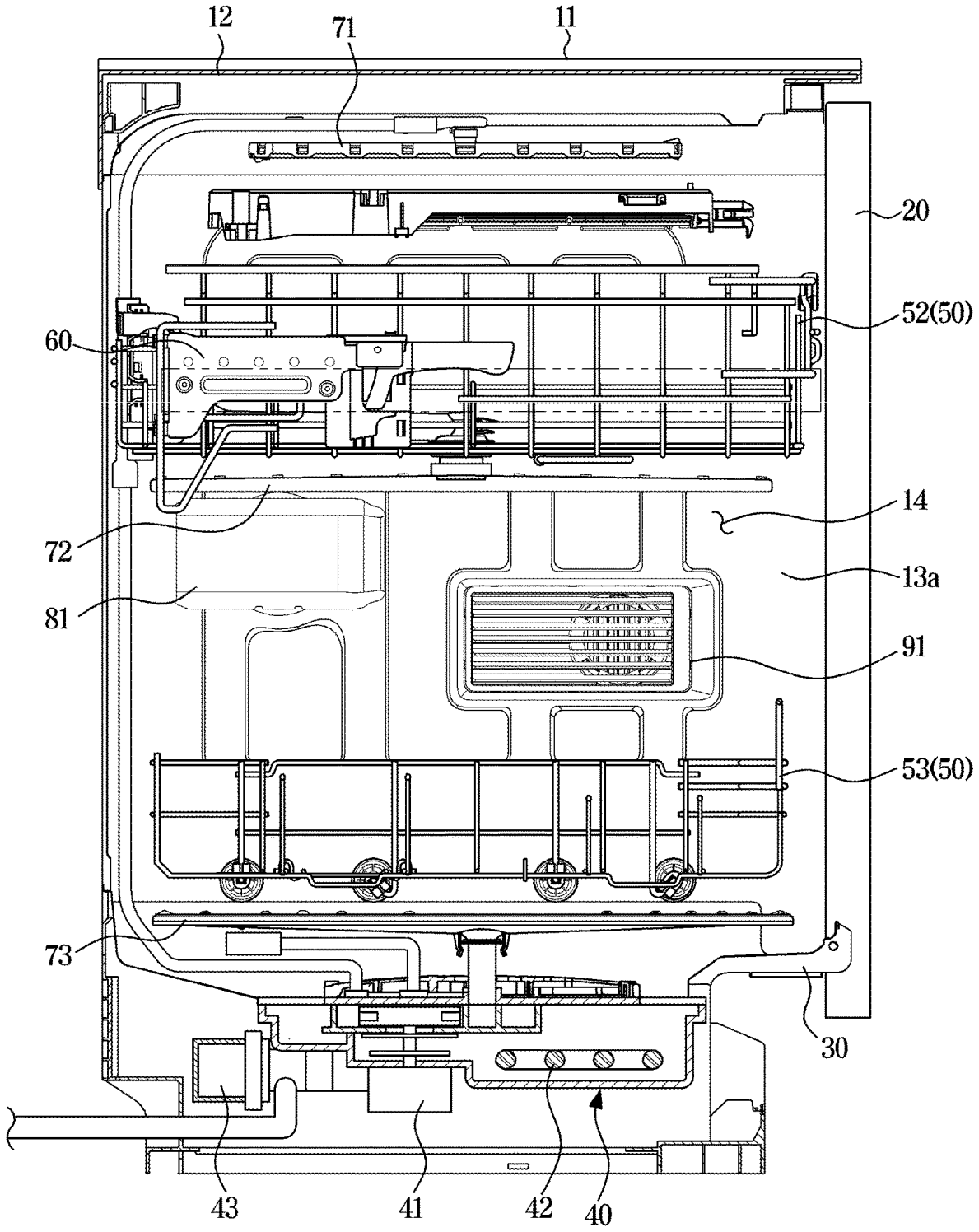
FIG. 2 is a cross-sectional view schematically showing a configuration of the dishwasher of FIG. 1.
Figure 3:
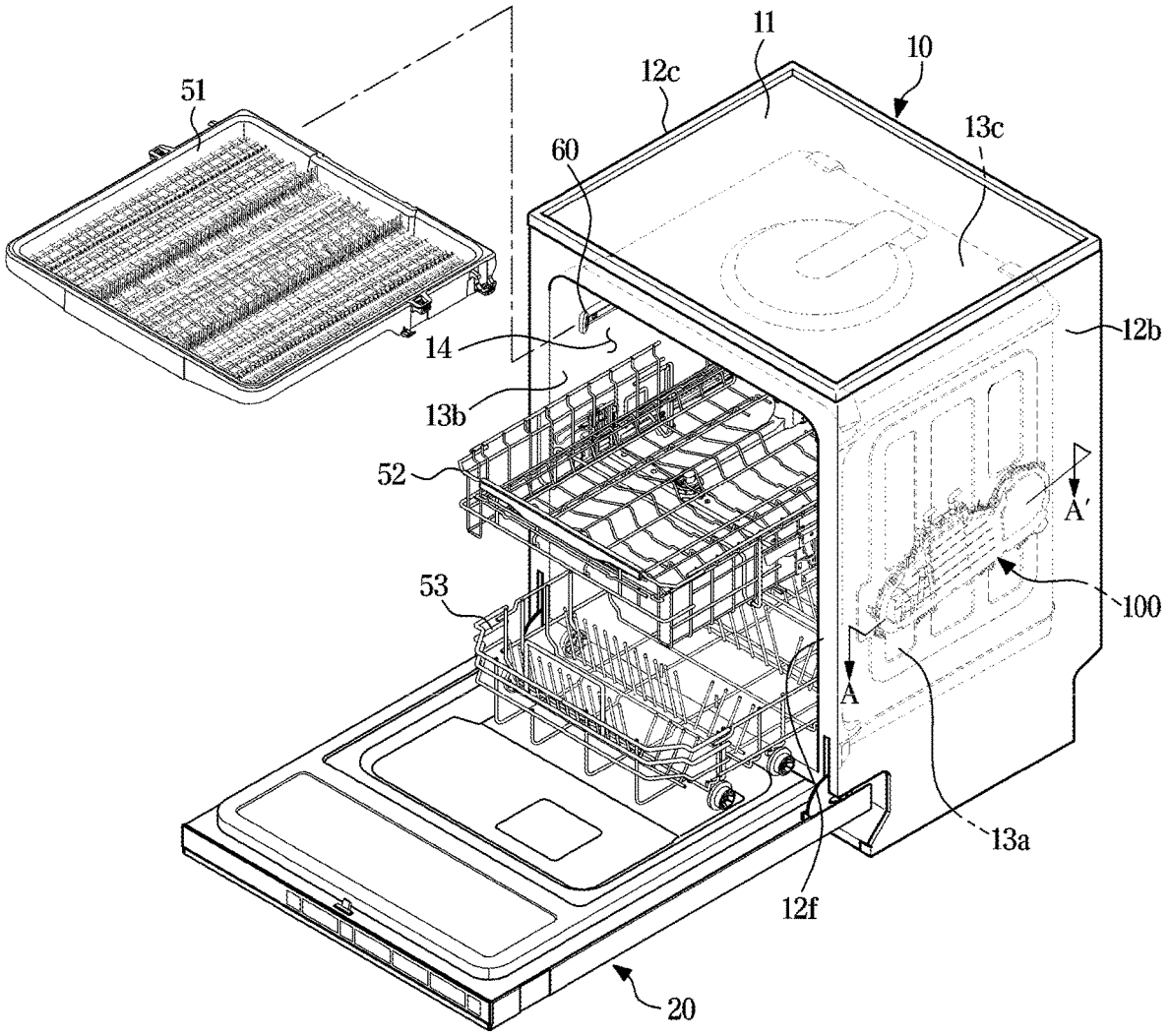
FIG. 3 is a perspective view of the dishwasher of FIG. 1, seen from one direction, after a door opens.
Figure 4:
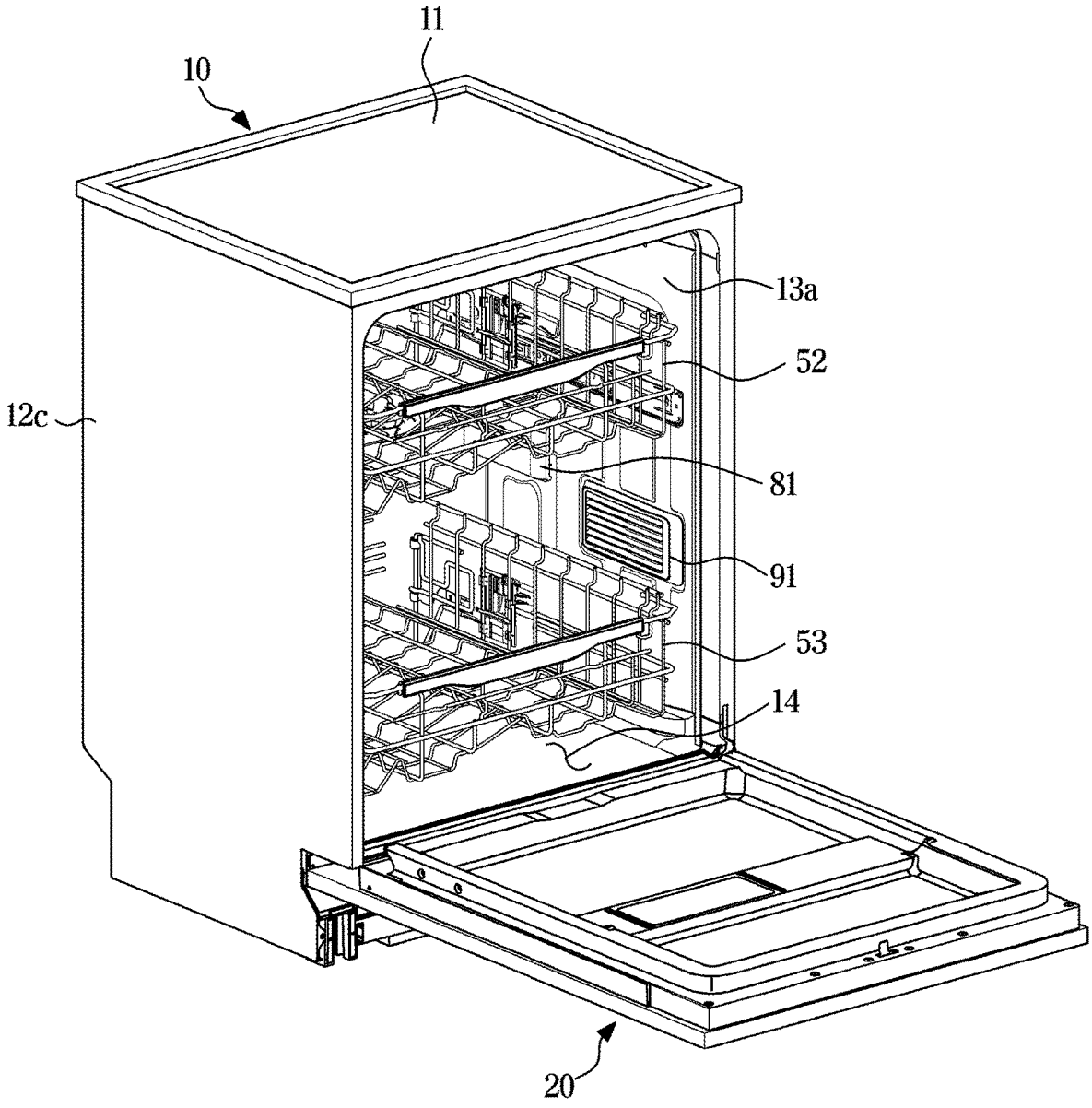
FIG. 4 is a perspective view of the dishwasher of FIG. 1, seen from another direction, after a door opens.

FIG. 1 is a perspective view showing a dishwasher according to an embodiment of the disclosure. FIG. 2 is a cross-sectional view schematically showing a configuration of the dishwasher of FIG. 1. FIG. 3 is a perspective view of the dishwasher of FIG. 1, seen from one direction, after a door opens. FIG. 4 is a perspective view of the dishwasher of FIG. 1, seen from another direction, after a door opens.

Referring to FIGS. 1 to 4, a dishwasher 1 may include a main body 10.

The main body 10 may include a cabinet 12 forming an outer appearance, and a tub 13 positioned inside the main body 10 and forming a washing room 14. In other words, the tub 13 may include the washing room 14 therein. However, the dishwasher 1 may be provided as a built-in type, and in this case, the cabinet 12 may be omitted.

The dishwasher 1 may include a door 20. The door 20 may be rotatably installed on the cabinet 12 to open or close the tub 13.

The cabinet 12 may be substantially in a shape of a box. One side of the cabinet 12 may open. That is, the cabinet 12 may have an opening 12*a*. For example, a front side of the cabinet 12 may open.

The cabinet 12 and the tub 13 may be substantially in a shape of a hexahedron of which one side has the opening 12*a*. The main body 10 may include a top cover 11 provided on a top of the cabinet 12, although not limited thereto. However, the cabinet 12 may itself form a top of the main body 10.

The cabinet 12 may include a rear plate 12*d*, both side plates 12*b* and 12*c* extending forward from both sides of the rear plate 12*d*, and a front plate 12*f* bent from the both side plates 12*b* and 12*c*.

The front plate 12*f* may form the opening 12*a* in the front side of the cabinet 12. The door 20 may open or close the opening 12*a* of the front plate 12*f*.

According to an embodiment of the disclosure, an example in which the front plate 12*f* extends from the both side plates 12*b* and 12*c* such that the front plate 12*f* and the both side plates 12*b* and 12*c* are formed as one body is shown, although not limited.

The door 20 may be rotatable with respect to the cabinet 12. More specifically, the door 20 may be rotatably hinge-coupled with a lower end of the cabinet 12. The door 20 may be coupled with the cabinet 12 by a hinge device 30.

Inside the cabinet 12, a sump unit 40 provided below the tub 13 and collecting water to be used for washing, a plurality of baskets 50 being withdrawable outward from inside of the cabinet 12 and accommodating dishes, a guide rack supporting the plurality of baskets 50, and a plurality of spray nozzles 71, 72, and 73 for spraying water transferred from the sump unit 40 toward the dishes accommodated in the plurality of baskets 50 may be positioned. The plurality of spray nozzles 71, 72, and 73 are also referred to as a spray unit 70.

In the plurality of baskets 50, dishes having relatively large volumes may be accommodated, although kinds and sizes of dishes that are accommodated in the plurality of baskets 50 are not limited. Dishes having relatively large or small volumes may also be accommodated in the plurality of baskets 50.

The plurality of baskets 50 may include a first basket 51, a second basket 52, and a third basket 53.

The first basket 51 may be coupled with the tub 13 in an upper portion of the tub 13 to be positioned above the second basket 52 and third basket 53.

The second basket 52 may be coupled with the tub 13 in a middle portion of the tub 13 to be positioned below the first basket 51 and/or above the third basket 53.

The third basket 53 may be coupled with the tub 13 in a lower portion of the tub 13 to be positioned below the first basket 51 and the second basket 52.

The first basket 51 may be a sub basket in which dishes having relatively small volumes are accommodated. Small cups such as espresso cups may be accommodated in the sub basket. However, kinds of dishes that are accommodated in the sub basket are not limited to the above example.

Also, the number of the plurality of baskets 50 is not limited to the above example, as long as the plurality of baskets 50 are arranged at different heights in an up-down direction to be spaced from each other.

The dishwasher 1 may include a plurality of guide racks 60 for supporting the plurality of baskets 50 inside the tub 13. The plurality of guide racks 60 may be provided as rails to enable the plurality of baskets 50 to be withdrawn forward.

The plurality of guide racks 60 may be installed on side walls 13*a* and 13*b* of the tub 13 such that the plurality of baskets 50 are slidable forward from the tub 13. For example, the plurality of guide racks 60 may be installed on left and right walls 13*a* and 13*b* of the tub 13.

The first basket 51, the second basket 52 and the third basket 53 may slide on the plurality of guide racks 60 to move in a front-rear direction of the tub 13.

The sump unit 40 may be installed in a lower center portion of the cabinet 12 to collect washing water to be used for washing.

The sump unit 40 may include a washing pump 41 for pumping water stored therein to the spray unit 70.

Washing water pumped by the washing pump 41 may be supplied to the first spray nozzle 71, the second spray nozzle 72, and the third spray nozzle 73 through a rear supply pipe.

The sump unit 40 may include a washing water heater 42 positioned in a lower portion of the cabinet 12 and configured to heat washing water, and a drain pump 43 positioned in a lower portion of the tub 13 to drain washing water to outside.

The dishwasher 1 may include the spray unit 70 for spraying washing water. The spray unit 70 may include the plurality of spray nozzles 71, 72, and 73.

The spray unit 70 may include the first spray nozzle 71 positioned above the first basket 51, the second spray nozzle 72 positioned below the first basket 51 and the second basket 52, that is, between the second basket 52 and the third basket 53, and the third spray nozzle 73 positioned below the third basket 53.

The first spray nozzle 71 may be rotatable. The first spray nozzle 71 may spray washing water toward dishes accommodated in the first basket 51 and/or the second basket 52. The second spray nozzle 72 may be rotatable.

The second spray nozzle 72 may spray washing water toward dishes accommodated in the second basket 52 and the third basket 53.

The third spray nozzle 73 may be rotatable. The third spray nozzle 73 may spray washing water toward the dishes accommodated in the third basket 53.

As shown in FIG. 3, the dishwasher 1 may include a dryer 100. The dryer 100 may be coupled with one wall of the tub 13. For example, the dryer 100 may be coupled with one of the side walls 13*a* and 13*b* of the tub 13. In FIG. 3, the dryer 100 is shown to be coupled with the left wall 13*a* of the tub 13. However, the dryer 100 may be coupled with the right wall 13*b* of the tub 13.

More specifically, the dryer 100 may be detachably installed on an outer side of the tub 13. The dryer 100 may be positioned between an outer side surface of the tub 13 and an inner side surface of the cabinet 12. That is, the dryer 100 may be positioned in a space formed between the cabinet 12 and the tub 13.

Humid air inside the washing room 14 may enter the inside of the dryer 100 positioned on the outer side of the tub 13 through an inlet cover 81 installed on an inner side of the tub 13, and dried air heated by the dryer 100 may be discharged to the washing room 14 through an outlet cover 91.

Also, the dishwasher 1 may include a height control device (not shown) positioned adjacent to the side walls 13*a* and 13*b* of the tub 13. The height control device may adjust a height at which the second basket 52 is inserted into the washing room 14.

For example, the second basket 52 may be raised in height toward the first basket 51 or lowered in height toward the third basket 53. However, although the height of the second basket 52 changes, there may be no interference between the inlet cover 81 and the second basket 52.

The inlet cover 81 and the outlet cover 91 may be installed on an inner side surface of the tub 13 between the plurality of baskets 50 positioned at different heights. In other words, an inlet 170 and an outlet 180 of the dryer 100 may be provided between the plurality of baskets 50 positioned at different heights. Details about the dryer 100 will be described below.

Figure 5:
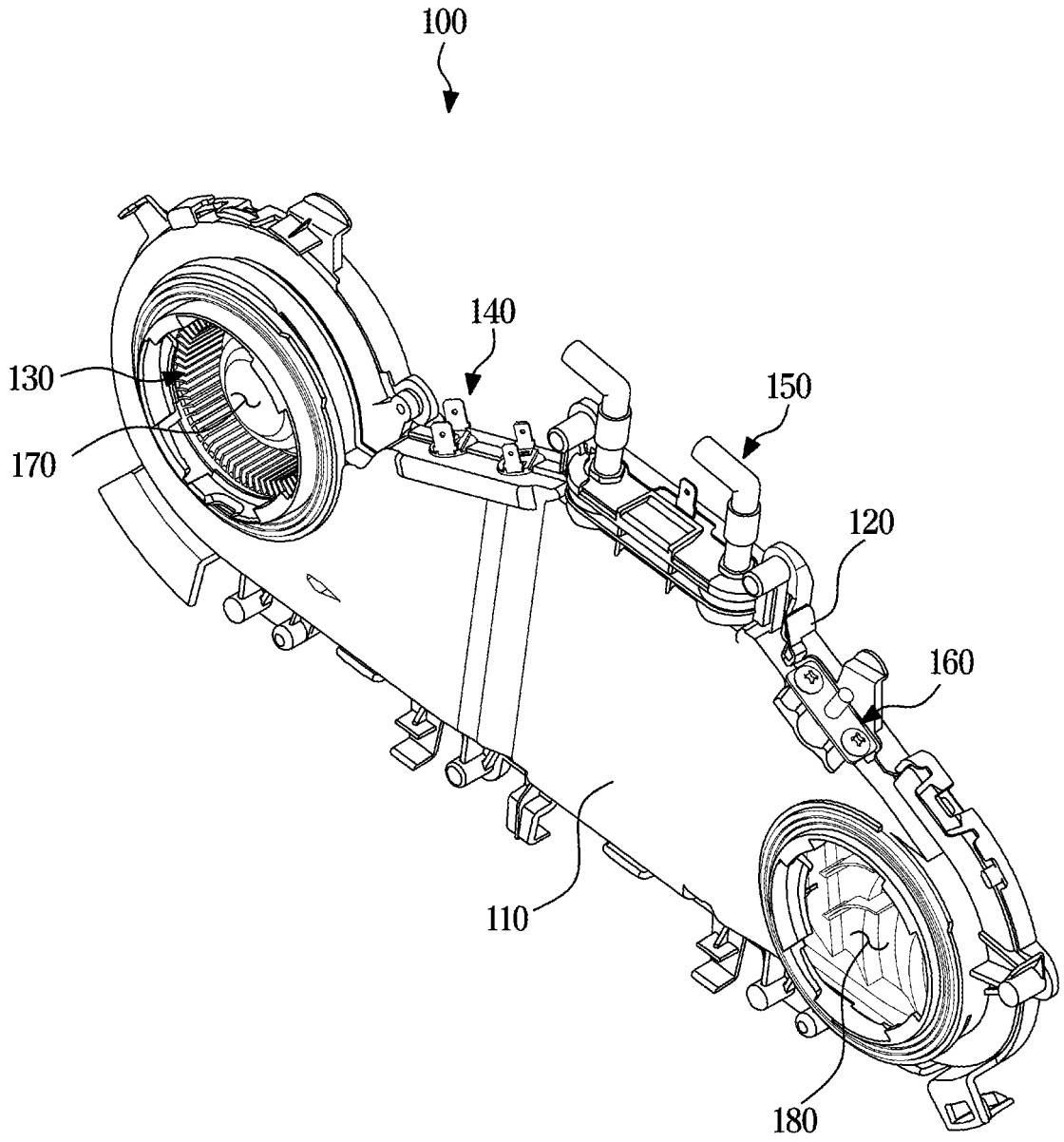
FIG. 5 is a perspective view of a dryer in a dishwasher according to an embodiment of the disclosure.
Figure 6:
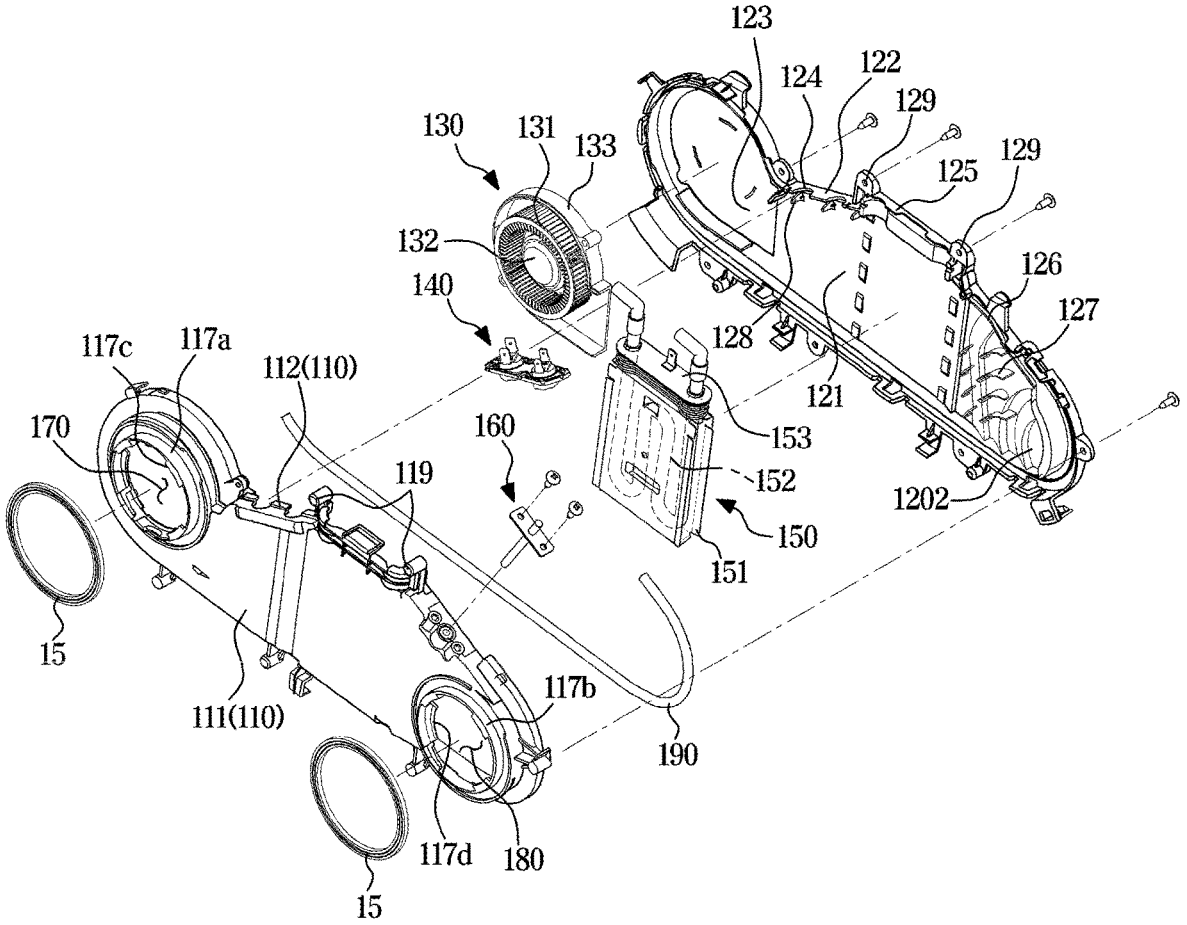
FIG. 6 is an exploded perspective view of the dryer shown in FIG. 5.
Figure 7:
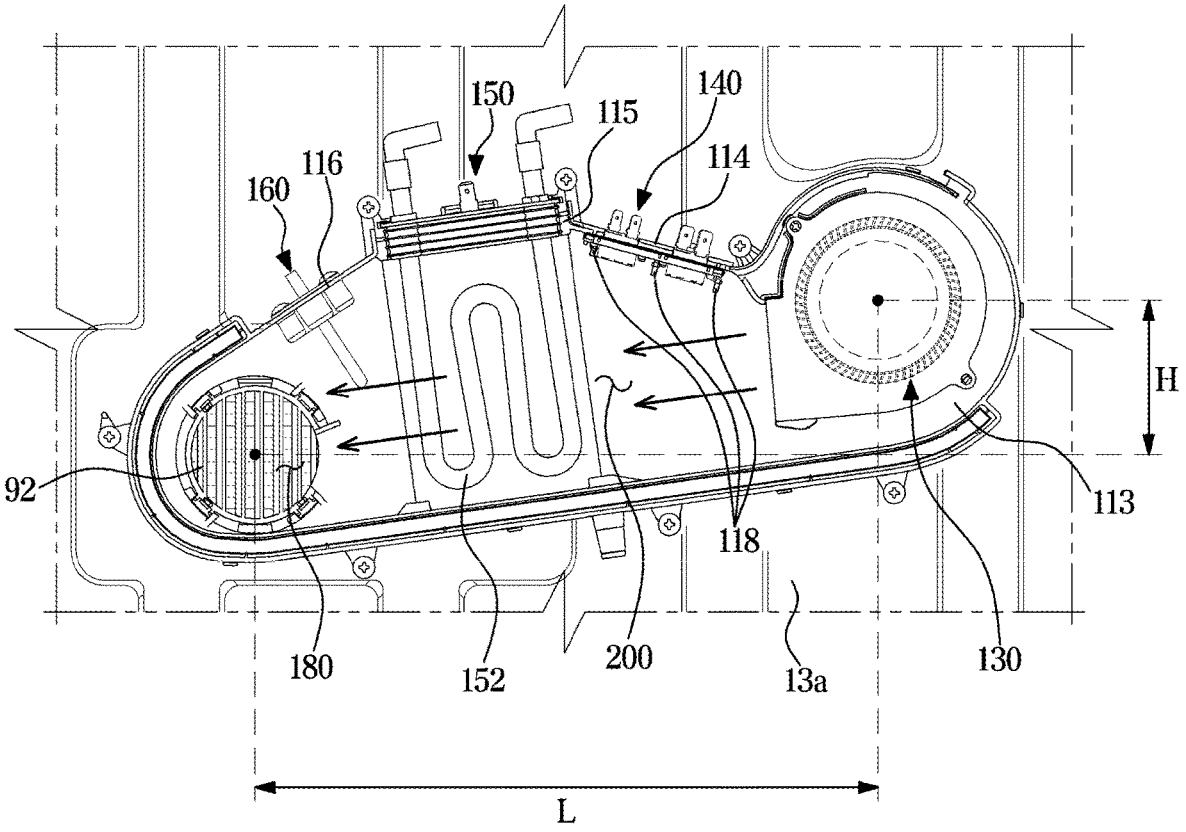
FIG. 7 shows a dryer installed on a tub in a dishwasher according to an embodiment of the disclosure, after a second housing is removed.
Figure 8:
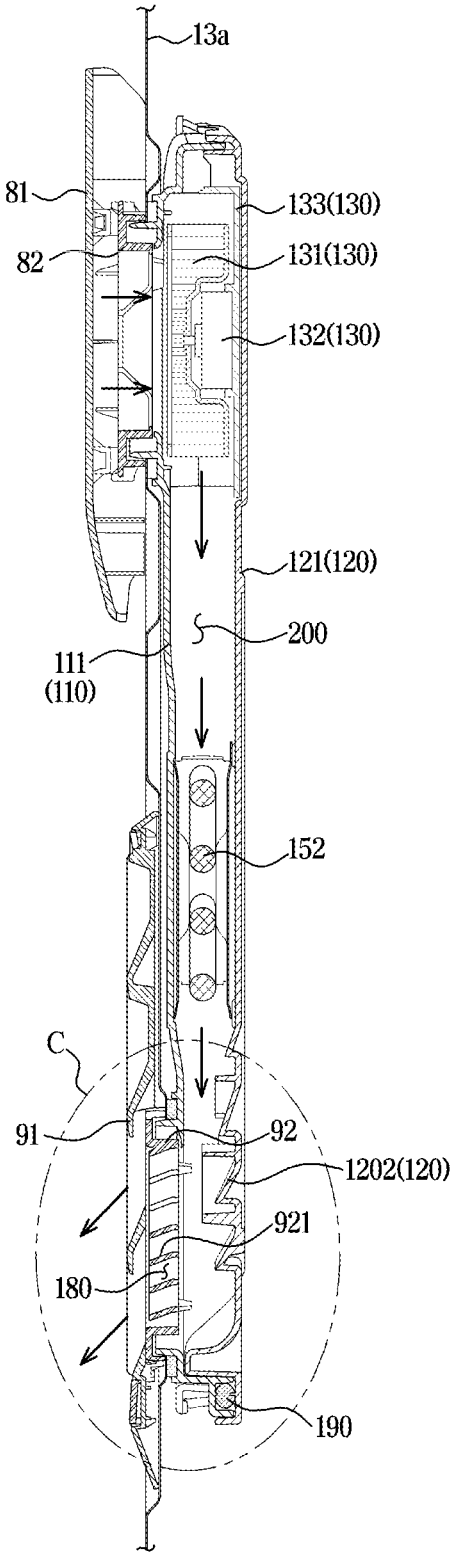
FIG. 8 is a cross-sectional view of the dishwasher taken along line A-A' of FIG. 3.

FIG. 5 is a perspective view of a dryer in a dishwasher according to an embodiment of the disclosure. FIG. 6 is an exploded perspective view of the dryer shown in FIG. 5. FIG. 7 shows a dryer installed on a tub in a dishwasher according to an embodiment of the disclosure, after a second housing is removed. FIG. 8 is a cross-sectional view of the dishwasher taken along line A-A' of FIG. 3.

Referring to FIGS. 5 to 7, the dishwasher 1 may include the dryer 100. The dryer 100 may be coupled with one side wall 13*a* of the tub 13.

The dishwasher 1 may perform a washing operation for washing dishes in the washing room 14, a rinsing operation for rinsing foreign materials, etc. remaining on the dishes, and a drying operation for drying inside air of the washing room 14 after the rinsing operation.

Through the drying operation, relative humidity of inside air of the washing room 14 may be lowered. In the present specification, air in the washing room 14 will be described, however, an embodiment of the disclosure may be applied in the same way to a fluid such as water.

The dryer 100 for performing a drying operation may include a first housing 110 and a second housing 120.

The first housing 110 may be coupled with the tub 13 and communicate with the washing room 14. The second housing 120 may be positioned on an outer side of the first housing 110 to form a flow path 200 together with the first housing 110 such that air of the washing room 14 circulates through the flow path. The first housing 110 may be coupled with the second housing 120 in such a way as to face the second housing 120.

The first housing 110 may include the inlet 170 and the outlet 180.

The inlet 170 may be formed in one side of the first housing 110 to enable air of the washing room 14 to enter the dryer 100. The inlet 170 may communicate with an inlet port (not shown) that opens in one side wall 13*a* or 13*b* of the tub 13 on which the dryer 100 is installed.

The outlet 180 may be formed in the other side of the first housing 110 to enable air to be discharged to the washing room 14. The outlet 180 may communicate with an outlet port (not shown) that opens in the one side wall 13*a* or 13*b* of the tub 13 on which the dryer 100 is installed.

In the dryer 100 according to an embodiment of the disclosure, the outlet 180 may be positioned in a front direction from the inlet 170 because the first and second housings 110 and 120 extends along the front-rear direction of the tub 13.

That is, air of a rear space of the washing room 14 may enter the dryer 100 through the inlet 170 formed in the first housing 110, and air heated by the dryer 100 may be discharged to a front space of the washing room 14 through the outlet 180 formed in the first housing 110.

The first housing 110 and the second housing 120 may include a plastic material.

The dryer 100 may include a fan assembly 130, a heater 150, a switch module 140, and a temperature sensor 160, which are accommodated in the first housing 110 and the second housing 120. However, some of the above-mentioned components may be omitted from the dryer 100.

The fan assembly 130 may include a fan 131, a motor 132, and a resting frame 133. The fan 131 may cause inside air of the washing room 14 to enter the flow path 200. The fan 131 may be positioned upstream of the switch module 140 and the heater 150 in the flow path 200. The fan 131 may be a centrifugal fan 131, although not limited thereto.

The motor 132 may be connected with the fan 131 to drive the fan 131. The resting frame 133 may cover the fan 131 and the motor 132 to rest the fan 131 and the motor 132 between the first housing 110 and the second housing 120. More specifically, the resting frame 133 may be coupled with a second fan installing portion 123 of the second housing 120.

The heater 150 may include a heater case 151, a sheath heater 152, and a power connector 153.

The heater case 151 may be coupled with an inner surface of the first housing 110 to accommodate the sheath heater 152 therein. The heater case 151 may form an outer appearance of the heater 150 to protect the sheath heater 152 therein. The sheath heater 152 may be a tube type heater.

Because the dishwasher 1 according to an embodiment of the disclosure uses the sheath heater 152 having a large thermal capacity to heat a fluid, condensed water existing in the first and second housings 110 and 120 will not cause any trouble in function of the heater 150.

For example, although condensed water is generated in the first and second housings 110 and 120 by a washing operation or a rinsing operation before a drying operation and enters the inside of the dryer 100, there may be no trouble in function of the heater 150.

The power connector 153 may receive power from the dishwasher 1. The power connector 153 may operate the sheath heater 152. The power connector 153 may be exposed from an upper portion of the first housing 110 and the second housing 120.

Thereby, the heater 150 may easily receive power from outside the dryer 100. Also, the power connector 153 may be electrically connected with the switch module 140 which will be described below, at a top of the dryer 100, to power off the sheath heater 152 through the switch module 140.

The switch module 140 may turn off the heater 150 upon overheating of inside air of the flow path 200 by the heater 150.

More specifically, in a state in which air does not flow due to failure of the fan 131 or the motor 132, the heater 150 fixed to the first housing 110 and the second housing 120 may continue to heat stagnant air. In this case, inside air of the flow path 200 may not circulate and be overheated.

In a case in which the heater 150 is not powered off, the overheated air may melt the first housing 110 and the second housing 120 made of a plastic material in the dryer 100, or a fire may break out inside the dishwasher 1.

To avoid such a safety accident, a switch 141 of the switch module 140 may turn off the heater 150 in response to an identification that temperature of air around the heater 150 reaches preset temperature.

Because hot air heated by the heater 150 rises upward, the switch module 140 may be positioned above the heater 150 to sensitively detect the heated air. Also, the switch module 140 may be positioned upstream of the heater 150.

More specifically, the switch module 140 may be positioned between the fan assembly 130 and the heater 150. Accordingly, the switch module 140 may accurately detect an upward flow of air heated by an operation of the heater 150 without any operation of the fan assembly 130.

The switch module 140 may be installed between the first housing 110 and the second housing 120. In other words, the switch module 140 may be installed between the first housing 110 and the second housing 120 and supported by both the first housing 110 and the second housing 120. Details about the switch module 140 will be described below.

The temperature sensor 160 may be installed between the first housing 101 and the second housing 120 to be positioned inside the flow path 200. The temperature sensor 160 may be positioned downstream of the heater 150.

The temperature sensor 160 may detect temperature of air heated by the heater 150 and transfer information about the detected temperature to a controller to thereby ultimately adjust temperature of air that is discharged to the inside of the washing room 14.

The dryer 100 may include a housing sealing member 190 positioned between the first housing 110 and the second housing 120. The housing sealing member 190 may seal between the first housing 110 and the second housing 120 that are coupled side by side with each other, thereby ultimately sealing the flow path 200. The housing sealing member 190 may be positioned at lower portions of the first housing 110 and the second housing 120.

Detailed structures of the first housing 110 and the second housing 120 of the dryer 100 will be described with reference to FIGS. 6 and 7.

The first housing 110 may include a first housing body 111 and a first side flange 112.

The first housing body 111 may be positioned side by side with the side wall 13*a* of the tub 13. The first side flange 112 may be bent from the first housing body 111 and extend toward the second housing 120. More specifically, the first side flange 112 may form an edge of the first housing body 111.

The first housing 110 may include a first cover coupling portion 117*a* and a second cover coupling portion 117*b*.

The first cover coupling portion 117*a* and the second cover coupling portion 117*b* may protrude outward from the first housing body 111. The first cover coupling portion 117*a* and the second cover coupling portion 117*b* may protrude toward the tub 13 from an outer surface of the first housing body 111.

In the first cover coupling portion 117*a*, a first accommodating rib 117*c* may be formed. The first accommodating rib 117*c* may protrude toward inside of the inlet 170 from the first cover coupling portion 117*a*.

The first accommodating rib 117*c* may be coupled with a coupling member 82 (see FIG. 8) which will be described below, the coupling member 82 positioned inside the inlet cover 81, such that the inlet cover 81 is fixed to the inner side of the tub 13 and the dryer 100 is fixed to the outer side of the tub 13.

In the same way, in the second cover coupling portion 117*b*, a second accommodating rib 117*d* may be formed. The second accommodating rib 117*d* may protrude toward inside of the outlet 180 from the second cover coupling portion 117*b*.

The second accommodating rib 117*d* may be interfered with an inner cover 92 (see FIG. 8) which will be described below, the inner cover 92 positioned inside the outlet cover 91, such that the outlet cover 91 is fixed to the inner side of the tub 13 and the dryer 100 is fixed to the outer side of the tub 13.

The first accommodating rib 117*c* and the second accommodating rib 117*d* may fix the inlet cover 81 and the outlet cover 91 to the inner side of the tub 13 and the dryer 100 to the outer side of the tub 13.

A plurality of cover sealing members 15 may be positioned between the first housing 110 and the tub 13. The plurality of cover sealing members 15 may seal between the dryer 100 and the tub 13.

Upon coupling of the dryer 100 with the outer side of the tub 13, the plurality of cover sealing members 15 may seal a gap between the tub 13 and the dryer 100. The plurality of cover sealing members 15 may be respectively installed at outer circumferences of the first cover coupling portion 117*a* and the second cover coupling portion 117*b*.

The first housing 110 may include a first fan installing portion 113, a first switch installing portion 114, a first heater installing portion 115, and a first sensor installing portion 116.

The first fan installing portion 113, the first switch installing portion 114, the first heater installing portion 115, and the first sensor installing portion 116 may be positioned sequentially along a flow direction on a path along which inside air of the flow path 200 flows.

The fan assembly 130 may be installed in the first fan installing portion 113. The first fan installing portion 113 may be formed in a rearmost portion of the first housing 110. The inlet 170 may be formed in a center of the first fan installing portion 113.

The first switch installing portion 114 may be positioned downstream of the first fan installing portion 113. The switch module 140 may be installed in the first switch installing portion 114. The first switch installing portion 114 may be formed across the first side flange 112 and the first housing body 111.

A part of the first side flange 112, corresponding to the first switch installing portion 114, may be cut to expose an upper portion of the switch module 140 from a top of the first housing 110.

The first heater installing portion 115 may be positioned downstream of the first switch installing portion 114. The first heater installing portion 115 may be formed across the first side flange 112 and the first housing body 111.

A part of the first side flange 112, corresponding to the first heater installing portion 115, may be cut to expose the heater 150 from the top of the first housing 110. The heater 150 may be coupled with the first heater installing portion 115.

The heater case 151 may be coupled with the first heater installing portion 115. However, in FIG. 7, the heater case 151 is not shown.

The first sensor installing portion 116 may be positioned downstream of the first heater installing portion 115. The first sensor installing portion 116 may be formed in the first side flange 112. The temperature sensor 160 may be installed in the first sensor installing portion 116. A part of the first side flange 112, corresponding to the first sensor installing portion 116, may be cut such that the temperature sensor 160 is exposed from the top of the first housing 110 to receive power.

The first housing 110 may include a first coupling portion 119. The first coupling portion 119 may be formed to correspond to a second coupling portion 129 (will be described below) of the second housing 120 such that the first housing 110 is firmly coupled with the second housing 120 through a separate coupling member. However, a position or shape of the first coupling portion 119 is not limited to that shown in the drawings.

The second housing 120 may be provided in a shape corresponding to the first housing 110.

The second housing 120 may include a second housing body 121 and a second side flange 122.

The second housing body 121 may be positioned side by side with the first housing body 111 in such a way as to face the first housing body 111. Accordingly, the second housing body 121 may also be provided side by side with the side wall 13*a* or 13*b* of the tub 13.

The second side flange 122 may be bent from the second housing body 121 and extend toward the first housing body 110. More specifically, the second side flange 122 may form an edge of the second housing body 121.

The second housing 120 may include a second fan installing portion 123, a second switch installing portion 124, a second heater installing portion 125, and a second sensor installing portion 126. The second fan installing portion 123, the second switch installing portion 124, the second heater installing portion 125, and the second sensor installing portion 126 may face the first fan installing portion 113, the first switch installing portion 114, the first heater installing portion 115, and the first sensor installing portion 116 of the first housing 110, respectively, and the above description about the first fan installing portion 113, the first switch installing portion 114, the first heater installing portion 115, and the first sensor installing portion 116 may also be applied in the same way to the second fan installing portion 123, the second switch installing portion 124, the second heater installing portion 125, and the second sensor installing portion 126.

The second fan installing portion 123, the second switch installing portion 124, the second heater installing portion 125, and the second sensor installing portion 126 may be positioned sequentially along the flow direction on the path along which inside air of the flow path 200 flows.

The fan assembly 130 may be installed in the second fan installing portion 123. The second fan installing portion 123 may be formed at the rearmost portion of the second housing 120.

The second switch installing portion 124 may be positioned downstream of the second fan installing portion 113. The switch module 140 may be installed in the second switch installing portion 124. The second switch installing portion 124 may be formed across the second side flange 122 and the second housing body 121. A part of the second side flange 122, corresponding to the second switch installing portion 124, may be cut to expose the upper portion of the switch module 140 from a top of the second housing 120.

The second heater installing portion 125 may be positioned downstream of the second switch installing portion 124. The second heater installing portion 125 may be formed across the second side flange 122 and the second housing body 121. A part of the second side flange 122, corresponding to the second heater installing portion 125, may be cut to expose the heater 150 from the top of the second housing 120. The heater 150 may be coupled with the second heater installing portion 125.

The second sensor installing portion 126 may be positioned downstream of the second heater installing portion 125. The second sensor installing portion 126 may be formed in the second side flange 122. The temperature sensor 160 may be installed in the second sensor installing portion 126. A part of the second side flange 122, corresponding to the second sensor installing portion 126, may be cut such that the temperature sensor 160 is exposed from the top of the second housing 120 to receive power.

The second housing 120 may include a second coupling portion 129. The second coupling portion 129 may be formed to correspond to the first coupling portion 119 of the first housing 110 such that the first housing 110 is firmly coupled with the second housing 120 through a separate coupling member. However, a position or shape of the second coupling portion 129 is not limited to that shown in the drawings.

Referring to FIG. 7, the first housing 110 may extend along an X direction (see FIG. 1). More specifically, the first housing 110 may extend along the front-rear direction of the tub 13. Because the second housing 120 has a shape corresponding to the first housing 110, the second housing 120 may also extend in the same direction as the first housing 110.

A center of the inlet 170 may be coaxial with a center of the fan assembly 130.

Accordingly, a distance L in X direction between the center of the inlet 170 and a center of the outlet 180 may be longer than a distance H in Z direction between the center of the inlet 170 and the center of the outlet 180.

Accordingly, humid air of the rear space of the washing room 14 may enter the dryer 100 through the inlet 170 of the dryer 100. Air dried and heated by the dryer 100 may be discharged to the front space of the washing room 14 through the outlet 180 of the dryer 100. In other words, the outlet 180 may be positioned in the front direction from the inlet 170. Because the outlet cover 91 is coupled with the inner side of the tub 13 at a location corresponding to the outlet 180, a user may easily recognize the location of the outlet 180 by looking in the inside of the tub 13.

Also, the dryer 100 may be positioned on the side wall 13*a* or 13*b* of the tub 13 in such a way as to extend along the front-rear direction of the tub 13 while being inclined downward with respect to the front direction. Therefore, water and a foreign material entered the inside of the dryer 100 may be naturally discharged through the outlet 180 by gravity.

A process in which inside air of the washing room 14 is sucked into the dryer 100 and then discharged from the dryer 100 to the washing room 14 during a drying operation will be described with reference to FIGS. 7 and 8, below.

Upon a start of a drying operation, the fan 131 in the dryer 100 may rotate. The fan 131 may suck humid inside air of the washing room 14 to the inside of the dryer 100. The sucked air may pass through the inlet cover 81 and the coupling member 82 and then flow to the inlet 170 of the dryer 100.

The air may flow along the flow path 200 formed between the first housing 110 and the second housing 120.

The fan 131 may be positioned upstream of the switch module 140, the heater 150, and the temperature sensor 160 to forcedly blow air such that the air flows through the fan 131, the switch module 140, the heater 150, and the temperature sensor 160, sequentially.

The switch module 140 may be positioned upstream of the heater 150 to detect air heated by the heater 150 and rising upward.

That is, the switch module 140 may be positioned above the heater 150 to detect overheating of air existing upstream of the heater 150 among inside air of the flow path 200 and turn off the heater 150.

Because the dryer 100 of the dishwasher 1 according to an embodiment of the disclosure extends in the front-rear direction while being inclined downward with respect to the front direction, the switch module 140 may be positioned around an upper portion of the heater 150 behind the heater 150.

Upon a normal operation of the fan assembly 130, upstream air of the heater 150 may be not overheated by air circulation generated by the fan 131. However, upon an abnormal operation of the fan assembly 130, no air circulation may be generated, and accordingly, upstream air of the heater 150 may be overheated by the heater 150. Therefore, the switch module 140 may be positioned downstream of the fan assembly 130 and upstream of the heater 150 to detect such abnormal overheating.

Air passed through the heater 150 may pass through the temperature sensor 160 and then flow to the outlet 180. The air entered the outlet 180 may pass through the inner cover 92 coupled with the first housing 110. The inner cover 92 may be positioned inside the outlet cover 91. Thereafter, the air may be discharged to the inside of the washing room 14 through the outlet cover 91.

The inner cover 92 may include an inner blade 921, and the outlet cover 91 may include an outlet blade. The inner blade 921 and the outlet blade may be inclined downward such that inside air of the flow path 200 is discharged toward a lower space of the tub 13, although positions of the inner blade 921 and the outlet blade are not limited thereto.

As shown in FIGS. 2, 4, and 8, the inlet cover 81 and the outlet cover 91 may be positioned between the plurality of baskets 50. More specifically, the inlet 170 and outlet 180 of the dryer 100 may be positioned between the second basket 51 and the third basket 53.

By extending the dryer 100 in the front-rear direction, a difference in height between the inlet 170 and the outlet 180 of the dryer 100 may become smaller. Accordingly, there may be little resistance by dishes accommodated in the baskets 50 upon flowing of air through the inlet 170, and even upon discharging of air through the outlet 180, there may be little resistance by the dishes, which leads to an improvement of drying performance of the dryer 100.

Also, even in a case in which the dishwasher 1 is implemented with a low height, the dryer 100 having the same performance may be installed on the side wall 13*a* or 13*b* of the tub 13, and accordingly, an installation limitation of the dryer 100 according to a height may be reduced.

Also, the first housing 110 and the second housing 120 of the dryer 100 may be slopingly installed on the side wall 13*a* of the tub 13 such that the outlet 180 is closer to the door 20 than the inlet 170.

Also, each of the side walls 13*a* and 13*b* of the tub 13 may be divided into a first area being adjacent to a top wall 13*c* of the tub 13, a second area being adjacent to a bottom of the tub 13, corresponding to a bottom of the washing room 14, and a third area provided between the first area and the second area.

The dryer 100 may be positioned only in the third area. That is, the dryer 100 may be positioned in a middle area of the side wall 13*a* or 13*b* of the tub 13 and extend in the front-rear direction.

Figure 9:
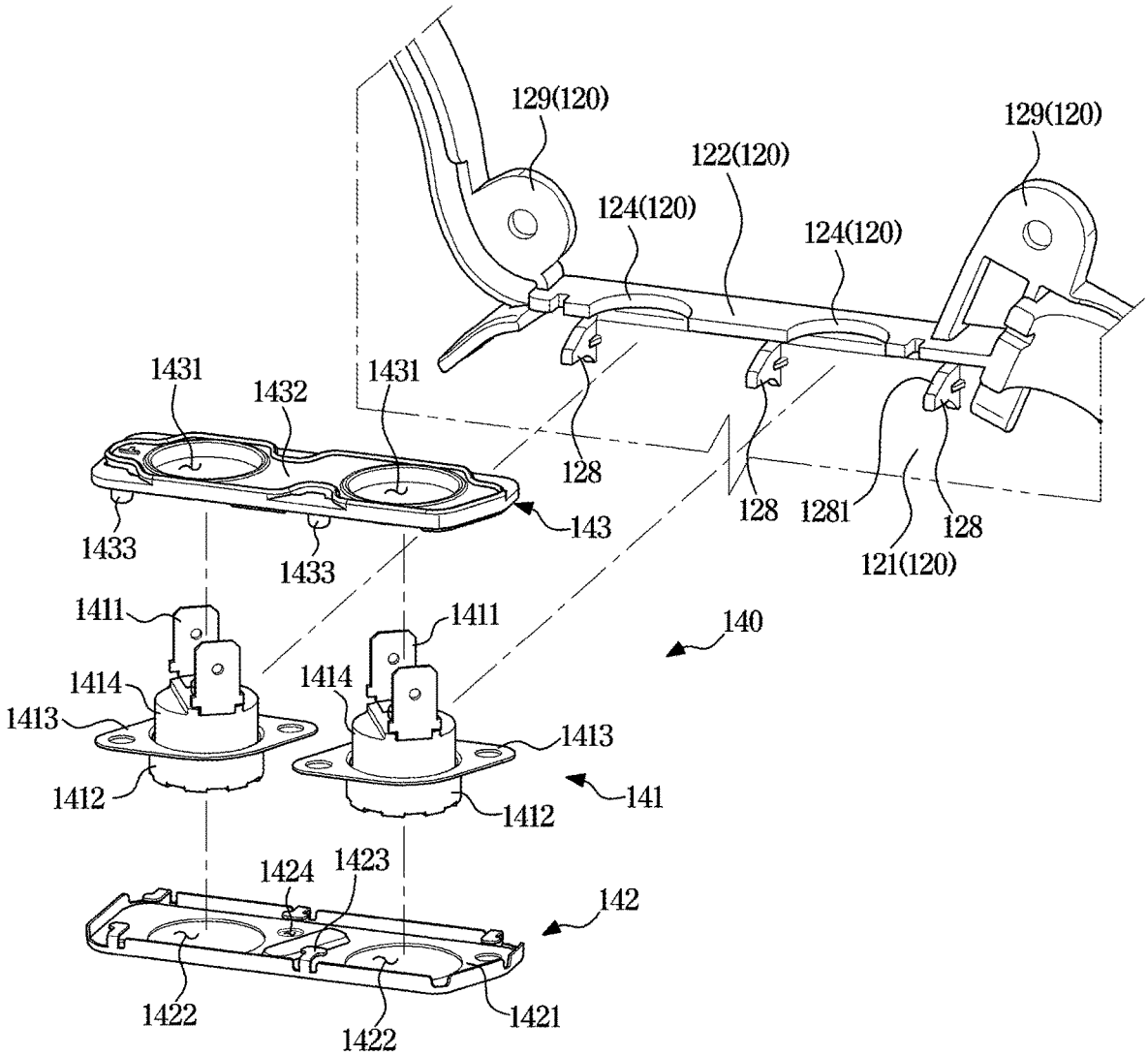
FIG. 9 is an exploded perspective view of a switch module in a dishwasher according to an embodiment of the disclosure.
Figure 10:
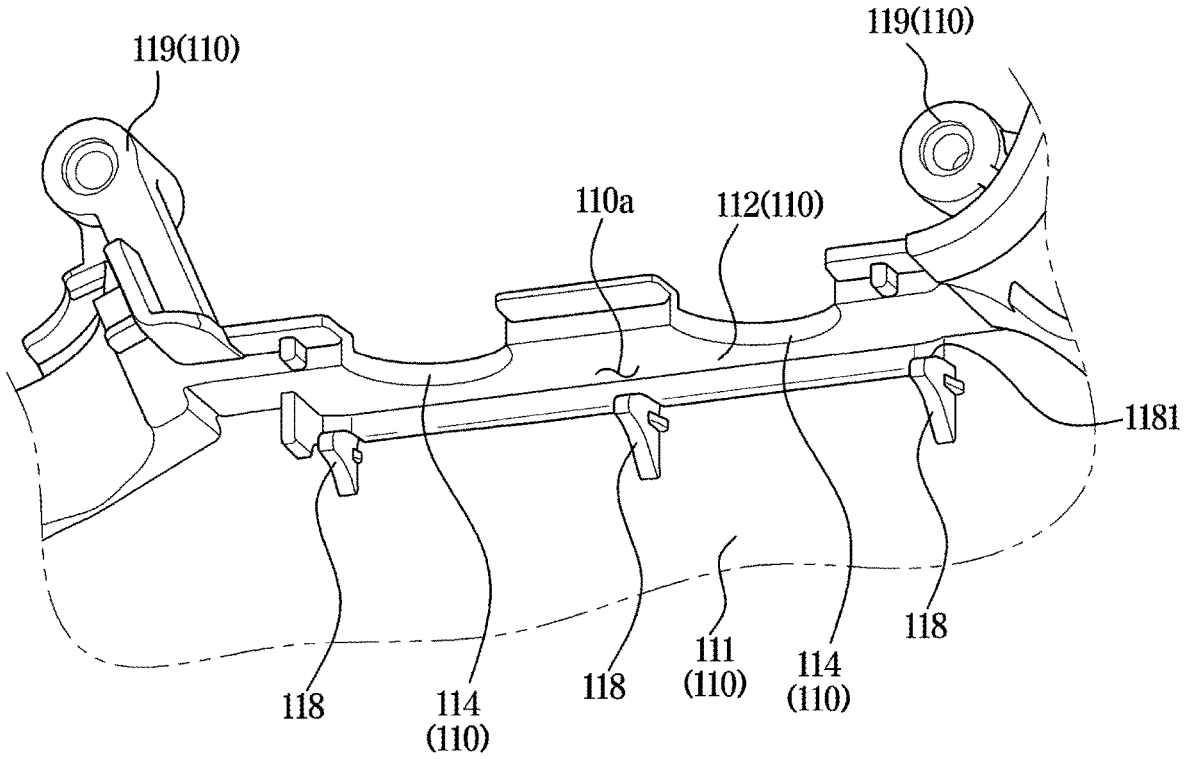
FIG. 10 shows a portion of a first housing of the dryer shown in FIG. 6.
Figure 11:
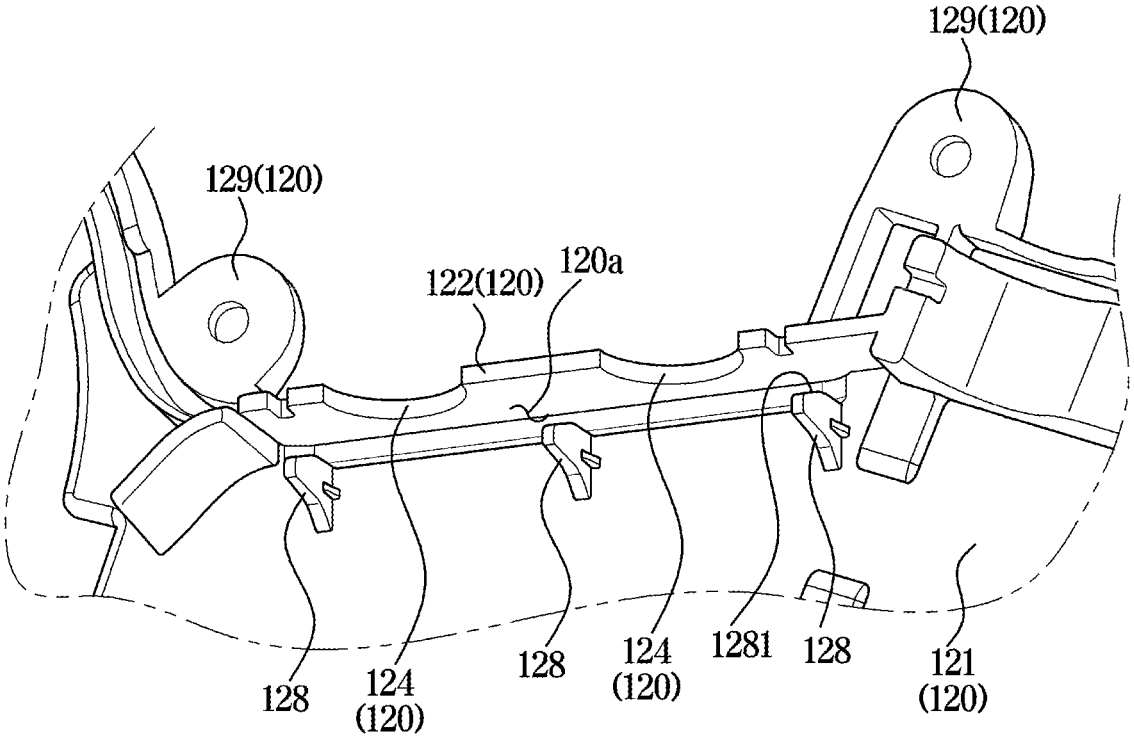
FIG. 11 shows a portion of a second housing of the dryer shown in FIG. 6.

FIG. 9 is an exploded perspective view of a switch module in a dishwasher according to an embodiment of the disclosure. FIG. 10 shows a portion of a first housing of the dryer shown in FIG. 6. FIG. 11 shows a portion of a second housing of the dryer shown in FIG. 6.

Referring to FIGS. 9 to 11, the dryer 100 may include the switch module 140.

The switch module 140 may include a switch 141, a holder 142, and a sealing member 143.

The switch 141 may turn off the heater 150 according to an identification that temperature of surrounding air of the heater 150 reaches preset temperature. The switch 141 may penetrate the holder 142 and the sealing member 143 such that an upper portion of the switch 141 protrudes outward from the sealing member 143 and a lower portion of the switch 141 protrudes outward from the holder 142.

The holder 142 may be supported by the first housing 110 and the second housing 120, and a portion of the switch 141 may be accommodated in the holder 142. A lower portion of the holder 142 may be supported by a first support rib 118 of the first housing 110 and a second support rib 128 of the second housing 120, which will be described below.

The holder 142 may include a metal material. Accordingly, heat transferred to the holder 142 may be easily transferred to a sensor 1412 of the switch 141.

The sealing member 143 may be positioned between the switch 141 and the holder 142 to seal the flow path 200. More specifically, the sealing member 143 may surround an outer side of the switch 141 inside the holder 142. The sealing member 143 may be deformable by an external force. For example, the sealing member 143 may be made of a flexible material such as rubber.

The holder 142 may include a cover portion 1421, a switch hole 1422, a fixing lag 1423, and a sealing hole 1424.

The cover portion 1421 of the holder 142 may correspond to a size of the sealing member 143 such that the sealing member 143 is accommodated inside the holder 142. The cover portion 1421 may be in a shape of a box of which one side opens.

The cover portion 1421 of the holder 142 may cover a side surface and a lower surface of the sealing member 143.

The fixing lag 1423 of the holder 142 may extend from the cover portion 1421 and press an upper surface of the sealing member 143 to fix relative positions between components of the switch module 140.

In the cover portion 1421 of the holder 142, a switch hole 1422 and a sealing hole 1424 may be formed.

The switch 141 may penetrate the holder 142 through the switch hole 1422. More specifically, the sensor 1412 (will be described below) of the switch 141 may penetrate the holder 142 through the switch hole 1422.

A guide protrusion 1433 of the sealing member 143 may be inserted in the sealing hole 1424. Thereby, the sealing member 143 may be easily positioned inside the holder 142.

The sealing member 143 may include a terminal hole 1431, a sealing portion 1432, and the guide protrusion 1433.

The sealing portion 1432 may be accommodated inside the holder 142 to seal the flow path 200 such that air does not flow to the outside of the dryer 100 through the flow path 200.

A portion of the switch 141 may penetrate the sealing member 143 through the terminal hole 1431. More specifically, a terminal 1411 of the switch 141 may be exposed to outside of the first housing 110 and the second housing 120 through the terminal hole 1431 of the sealing member 143. That is, the terminal 1411 of the switch 141 may be positioned outside the flow path 200.

The guide protrusion 1433 may protrude downward from the sealing portion 1432 of the sealing member 143 and be inserted in the sealing hole 1424 of the holder 142. Accordingly, the switch module 140 may be easily assembled, and the sealing member 143 may be firmly fixed inside the holder 142.

The switch 141 may include the terminal 1411, the sensor 1412, a fixing portion 1413, and a switching portion 1414.

The terminal 1411 may be electrically connected with the heater 150 to turn off the heater 150. The terminal 1411 may be formed in an upper portion of the switch 141. The terminal 1411 may protrude outward from the first housing 110 and the second housing 120.

More specifically, the terminal 1411 may be exposed upward from the dryer 110, and positioned in a space between the tub 13 and the cabinet 12. The terminal 1411 may be electrically connected with the heater 150 outside the first housing 110 and the second housing 120.

The sensor 1412 may protrude to the inside of the flow path 200 to detect temperature of the flow path 200. The sensor 1412 may be positioned upstream of the heater 150 to detect temperature of air around the heater 150. The sensor 1412 may penetrate the switch hole 1422 of the holder 142 to be exposed to the flow path 200. That is, the sensor 1412 may penetrate the holder 142 inside the first housing 110 and the second housing 120 to detect temperature of the flow path 200.

The switching portion 1414 may turn on or off the heater 150. That is, the switching portion 1414 may block power that is supplied to the heater 150.

The fixing portion 1413 may extend outward from the sensor 1412 to be positioned side by side with the holder 142 and accommodated between the sealing member 143 and the holder 142. More specifically, a lower side of the fixing portion 1413 may be in contact with an inner side of the holder 142, and an upper side of the fixing portion 1413 may be in contact with an inner side of the sealing member 143.

The switching module 140 may be supported by the first housing 110 and the second housing 120 without a separate coupling member, and fixed. Hereinafter, details about the switching module 140 will be described.

Referring to FIG. 10, the first housing 110 may include a first support rib 118.

The first support rib 118 may protrude from an inner surface of the first housing body 111 to support the switching module 140 from below. More specifically, the first support rib 118 may be formed in the first housing body 111 in such a way to be spaced from the first side flange 112. A plurality of first support ribs 118 may be provided. In FIG. 10, three support ribs 118 are shown. However, the number of the first support ribs 118 is not limited to three.

A first switch accommodating space 110*a* may be formed between the first support rib 118 and the first side flange 112. A part of a lower portion of the switch module 140 may be accommodated in the first switch accommodating space 110*a*. Also, a part of an upper portion of the first side flange 112, corresponding to the first switch installing portion 114 may be cut such that a portion of the switch module 140 protrudes upward from the first housing 110.

The first support rib 118 may include a first chamfer portion 1181 formed on an upper surface of the first support rib 118 and inclined downward toward an end.

The switch module 140 may be inserted into the first switch accommodating space 110*a* toward the first housing body 111 from the one end of the first support rib 118. Accordingly, the first chamfer portion 1181 may be formed on the upper surface of the first support rib 118 such that the switch module 140 is more easily inserted into the first switch accommodating space 110*a*.

Referring to FIGS. 9 and 11, the second housing 120 may include the second support rib 128.

The second support rib 128 may protrude from an inner surface of the second housing body 121 and support the switch module 140 from below. More specifically, the second support rib 128 may be formed on the second housing body 121 in such a way as to be spaced from the second side flange 122. A plurality of second support ribs 128 may be provided. In FIGS. 9 and 11, three second support ribs 128 are shown. However, the number of the second support ribs 128 is not limited to three.

A second switch accommodating space 120*a* may be formed between the second support rib 128 and the second side flange 122. A part of the lower portion of the switch module 140 may be accommodated in the second switch accommodating space 120*a*. Also, a portion of the second side flange 122, corresponding to the second switch installing portion 124 may be cut such that a part of an upper portion of the switch module 140 protrudes upward from the second housing 110.

The second support rib 128 may include a second chamfer portion 1281 formed on an upper surface of the second support rib 128 and inclined downward toward one end.

The switch module 140 may be inserted into the second switch accommodating space 120*a* toward the second housing body 121 from the one end of the second support rib 128. Accordingly, the second chamfer portion 1281 may be formed on the upper surface of the second support rib 128 such that the switch module 140 is more easily inserted into the second switch accommodating space 120*a*.

The switch module 140 may be fixed with respect to the first housing 110 and the second housing 120 by being inserted into the first switch accommodating space 110*a* of the first housing 110 and then inserted into the second switch accommodating space 120*a* of the second housing 120 upon coupling of the second housing 120 with the first housing 110, although not limited thereto.

However, the switch module 140 may be fixed with respect to the first housing 110 and the second housing 120 by being inserted into the second switch accommodating space 120*a* of the second housing 120 and then inserted into the second switch accommodating space 110*a* of the first housing 110 upon coupling of the second housing 120 with the first housing 110.

Figure 12:
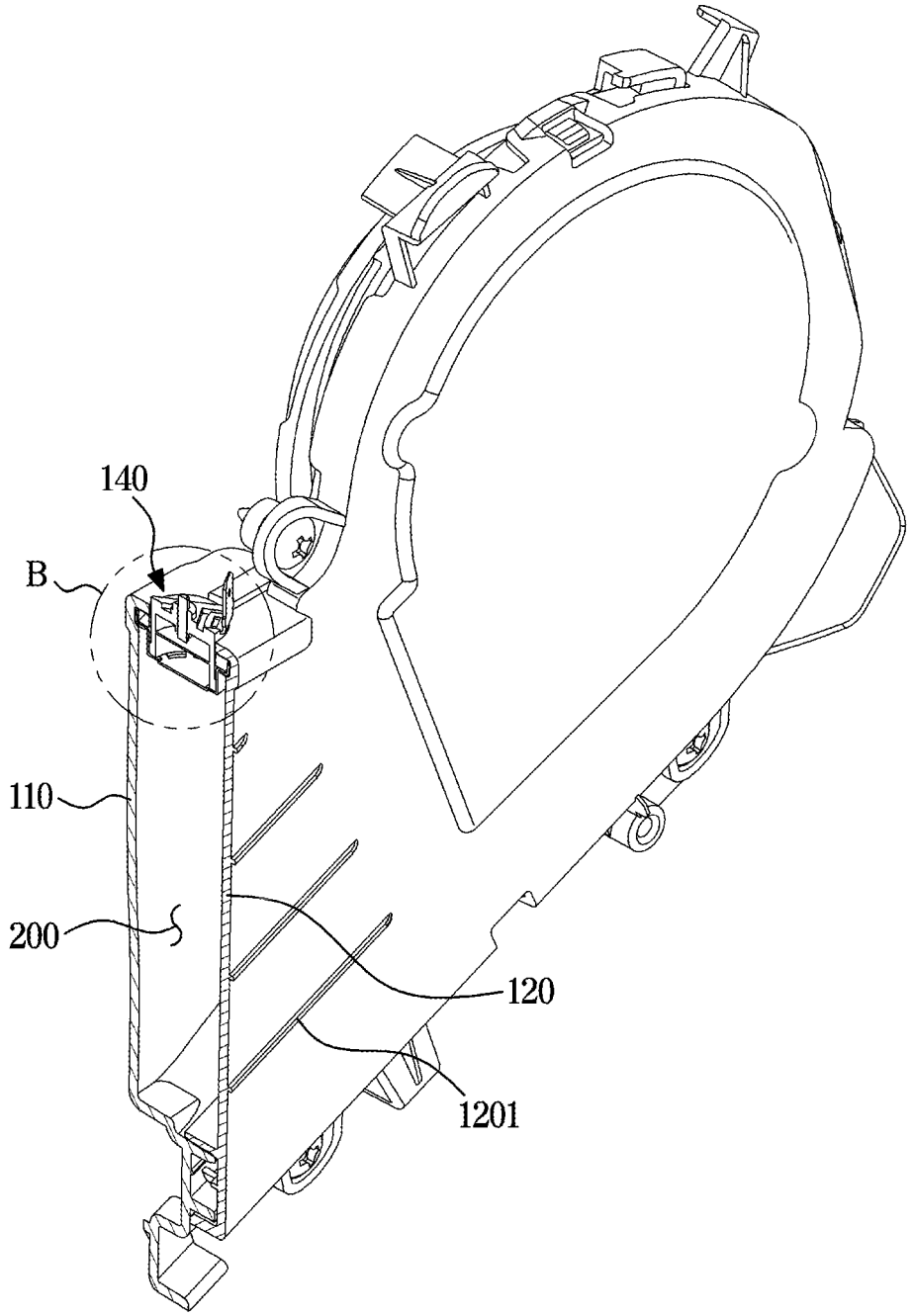
FIG. 12 is a sectional perspective view showing a front side of a switch module installed in a housing in a dishwasher according to an embodiment of the disclosure.
Figure 13:
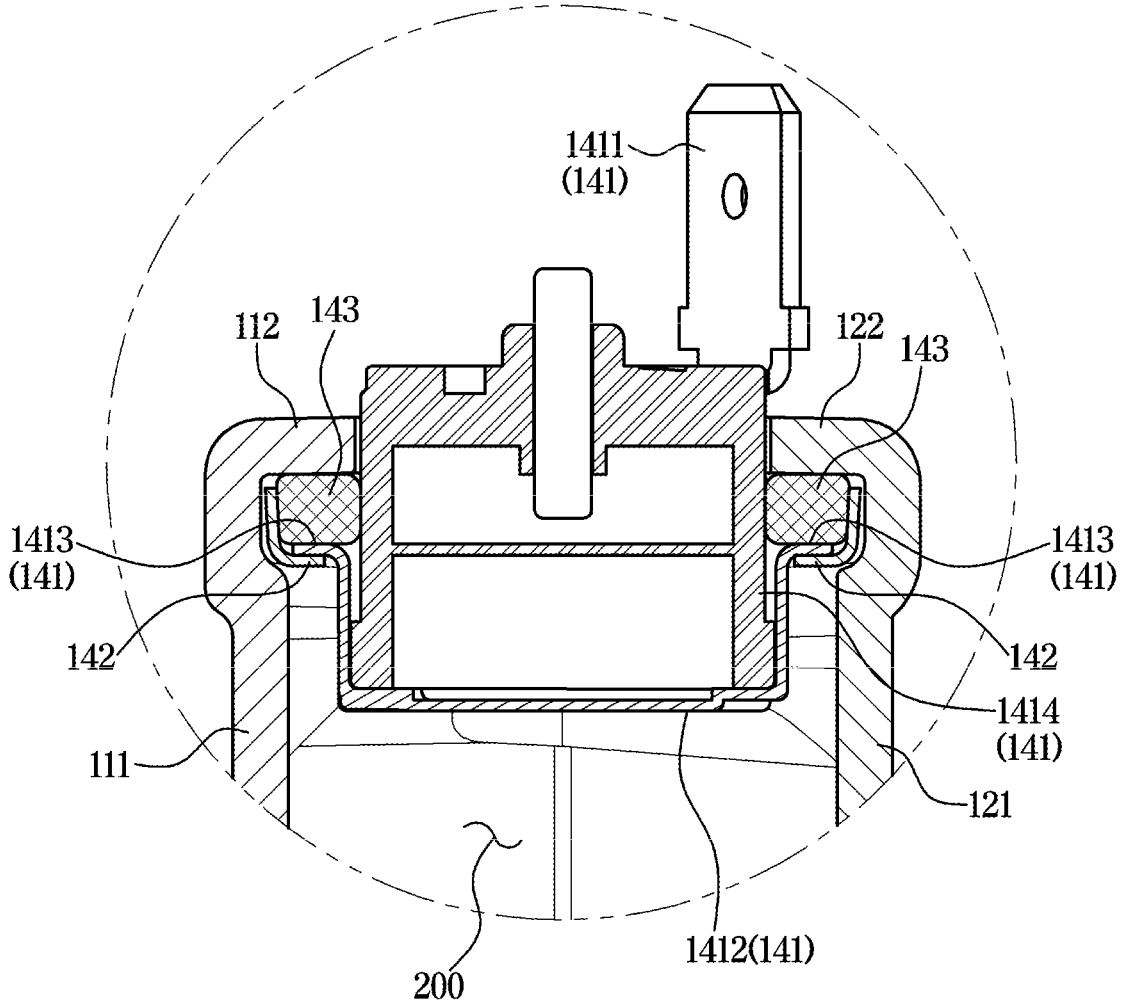
FIG. 13 is an enlarged front view of an area B of FIG. 12.

FIG. 12 is a sectional perspective view showing a front side of a switch module installed in a housing in a dishwasher according to an embodiment of the disclosure. FIG. 13 is an enlarged front view of an area B of FIG. 12.

Referring to FIGS. 12 and 13, the switch module 140 may be positioned between the first housing 110 and the second housing 120 such that a portion of the switch module 140 is positioned inside the first housing 110 and the second housing 120 and the remaining portion of the switch module 140 is positioned outside the first housing 110 and the second housing 120. In other words, the switch module 140 may penetrate top surfaces of the first housing 110 and the second housing 120 extending in the front-rear direction.

The holder 142 of the switch module 140 may be supported by the first support rib 118 of the first housing 110 and the second support rib 128 of the second housing 120 at the lower portion, as described above.

The fixing portion 1413 of the switch 141 may be positioned between the holder 142 and the sealing member 143 to fix a position of the switch 141.

Also, the sealing member 143 positioned inside the holder 142 may be pressed by the first side flange 112 of the first housing 110 and the second side flange 122 of the second housing 120 from above. Because the sealing member 143 is made of a deformable material, the sealing member 143 may be compressed to maintain sealing.

The sensor 1412 of the switch 141 may pass through the holder 142 and protrude downward toward the flow path 200. Instead that the sealing member 143 is positioned between the switch 141 and the holder 142, the switch 141 may contact the holder 142 and the sealing member 143 may be positioned on the switch 141 to seal the flow path 200. Accordingly, the sensor 1412 of the switch 141 may protrude to the flow path 200 at a wider area, resulting in an improvement of sensing capability of the switch module 140.

The terminal 1411 of the switch 141 may pass through the sealing member 143, the first side flange 122, and the second side flange 122, and protrude upward from the first housing 110 and the second housing 120. Accordingly, an electrical connection between the terminal 1411 and the heater 150 may be made above the dryer 100.

Also, referring to FIG. 12, a spacing rib 1201 may be formed on an outer side of the second housing 120.

The spacing rib 1201 may protrude in a direction toward the cabinet 12 from an outer side surface of the second housing 120. The spacing rib 1201 may space the outer side of the second housing 120 from an inner surface of the cabinet 12.

For example, the spacing rib 1201 may space the second housing 120 from the side plate 12*b* or 12*c* of the cabinet 12. Accordingly, because a space is formed between the dryer 100 and the cabinet 12, heat generated by the heater 150 may be prevented from being directly transferred to the cabinet 12. Also, air may circulate through the space between the cabinet 12 and the dryer 100.

A plurality of spacing ribs 1201 may be provided. In FIG. 12, four spacing ribs 1201 may be formed separately along a height direction. However, the number of the spacing ribs 1201 is not limited to four.

Figure 14:
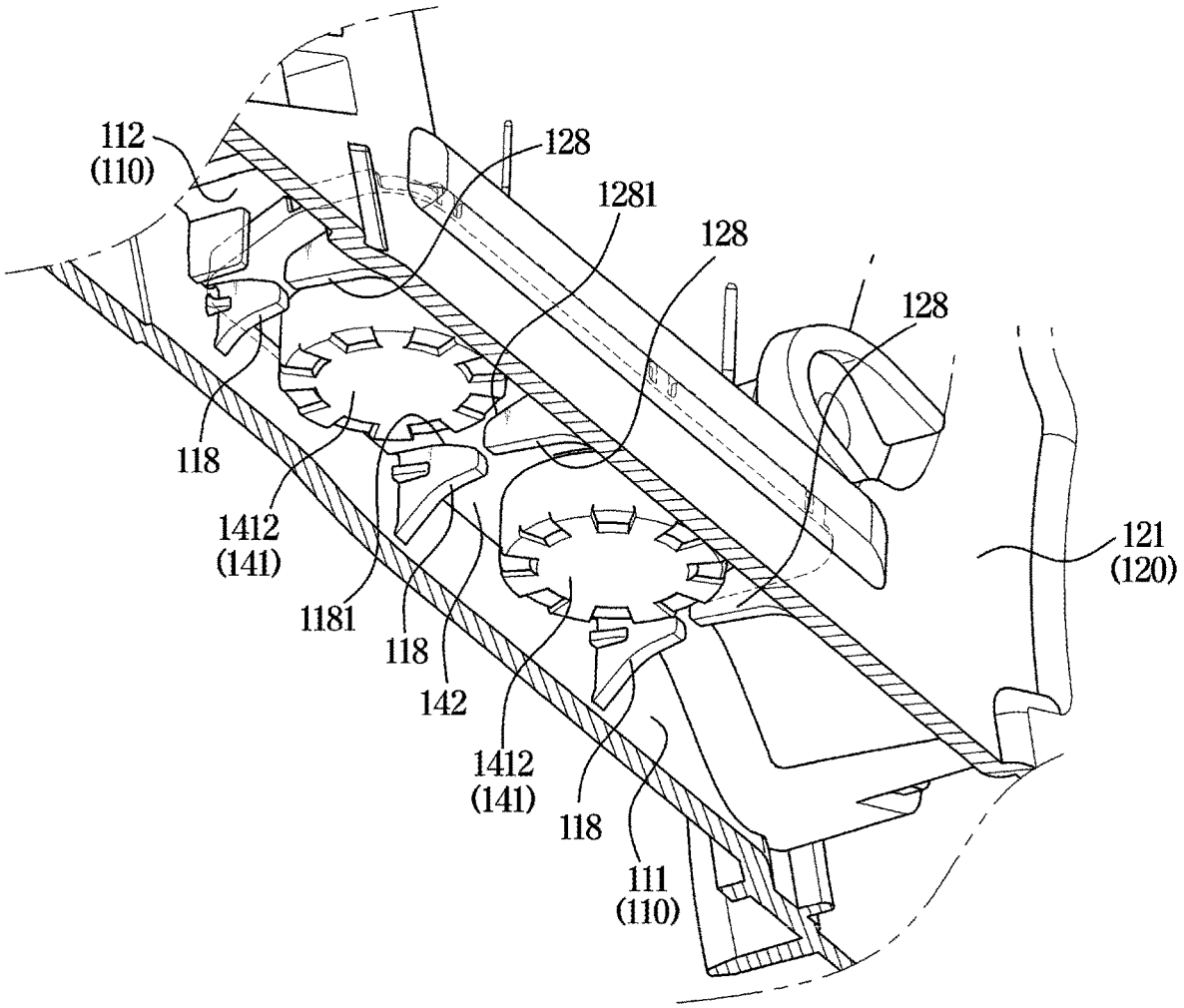
FIG. 14 is a sectional perspective view showing a bottom of a switch module installed in a housing in a dishwasher according to an embodiment of the disclosure.

FIG. 14 is a sectional perspective view showing a bottom of a switch module installed in a housing in a dishwasher according to an embodiment of the disclosure.

Referring to FIG. 14, the plurality of first support ribs 118 may support the holder 142 of the switch module 140 from below one side. Also, the plurality of second support ribs 128 may support the holder 142 of the switch module 140 from below the other side. Upon coupling of the first housing 110 with the second housing 120, the second support ribs 128 may face the first support ribs 118 at staggered positions.

Accordingly, the switch module 140 may be fixed in position by being inserted between the upper surfaces of the first and second support ribs 118 and 128 and the first and second switch installing portions 114 and 124 of the switch 141 without a separate coupling member.

Thereby, probability that assembly omission caused by missing a screw, etc. will occur in a production line may be reduced, and ease of assembly may be improved.

Also, because the switch module 140 protrudes from the top surfaces of the first housing 110 and the second housing 120, the switch module 140 may be electrically connected with the heater 150 above the dryer 100, resulting in improved space utilization.

In addition, because the switch module 140 is installed with a compact size at an area where the first housing 110 is in contact with the second housing 120, a loss of an area of the flow path 200 may be reduced.

Figure 15:
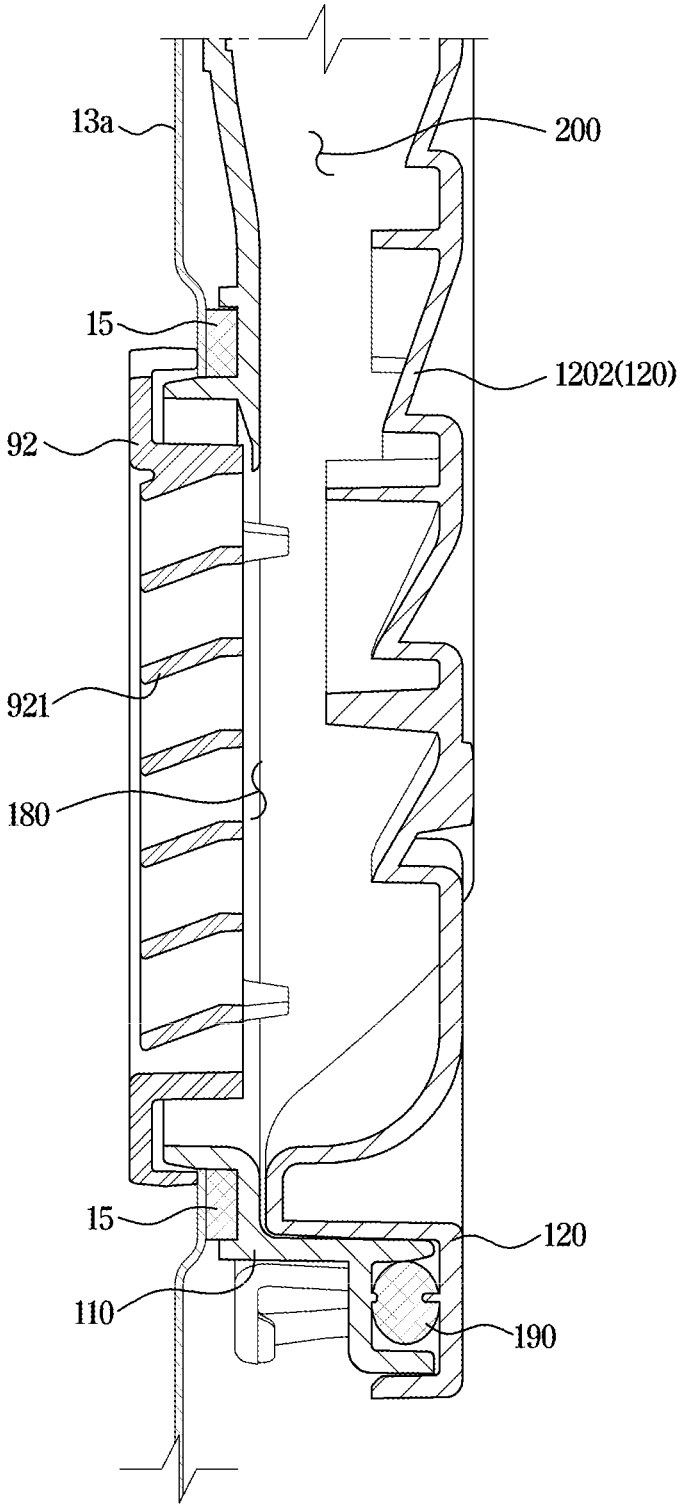
FIG. 15 is an enlarged view of an area C of FIG. 8.

FIG. 15 is an enlarged view of an area C of FIG. 8.

Referring to FIG. 15, the second housing 120 of the dryer 100 may include an outlet portion 1202 that faces the outlet 180 formed in the first housing 110.

The outlet 180 of the dryer 100 may communicate with the washing room 14 through the inner cover 92 coupled with the inner side of the tub 13. In FIG. 15, the outlet cover 91 coupled with an inner surface of the tub 13 to accommodate the inner cover 92 is not shown.

Air dried and heated by the dryer 100 may move toward the washing room 14 through the outlet 180. Also, water or a foreign material generated in the washing room 14 may enter the inside of the dryer 100 through the outlet 180. Accordingly, the dryer 100 of the dishwasher 1 according to an embodiment of the disclosure may prevent internal components from being damaged by water or a foreign material.

Figure 16:
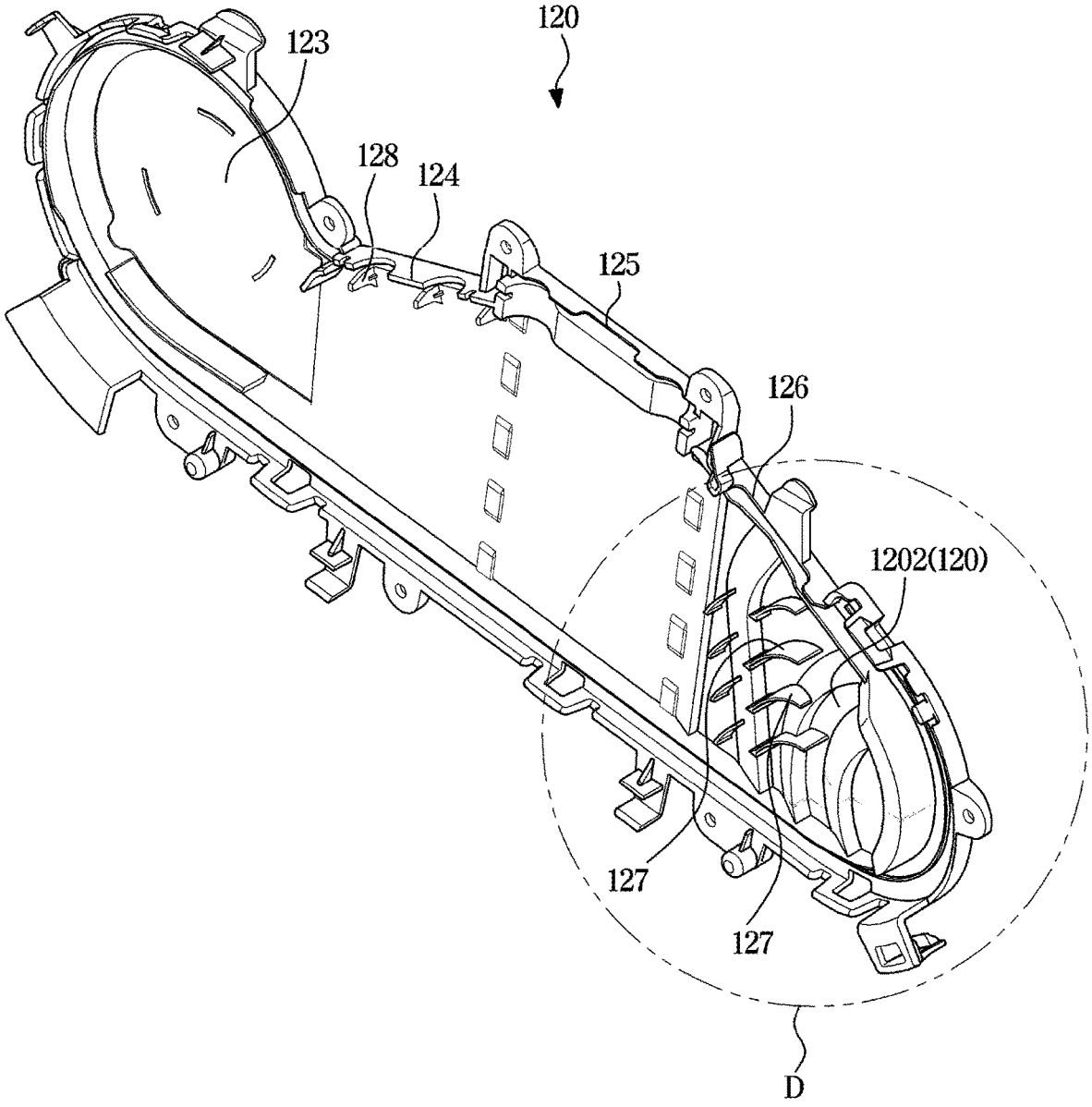
FIG. 16 shows an inner side of a second housing of the dryer shown in FIG. 6.
Figure 17:
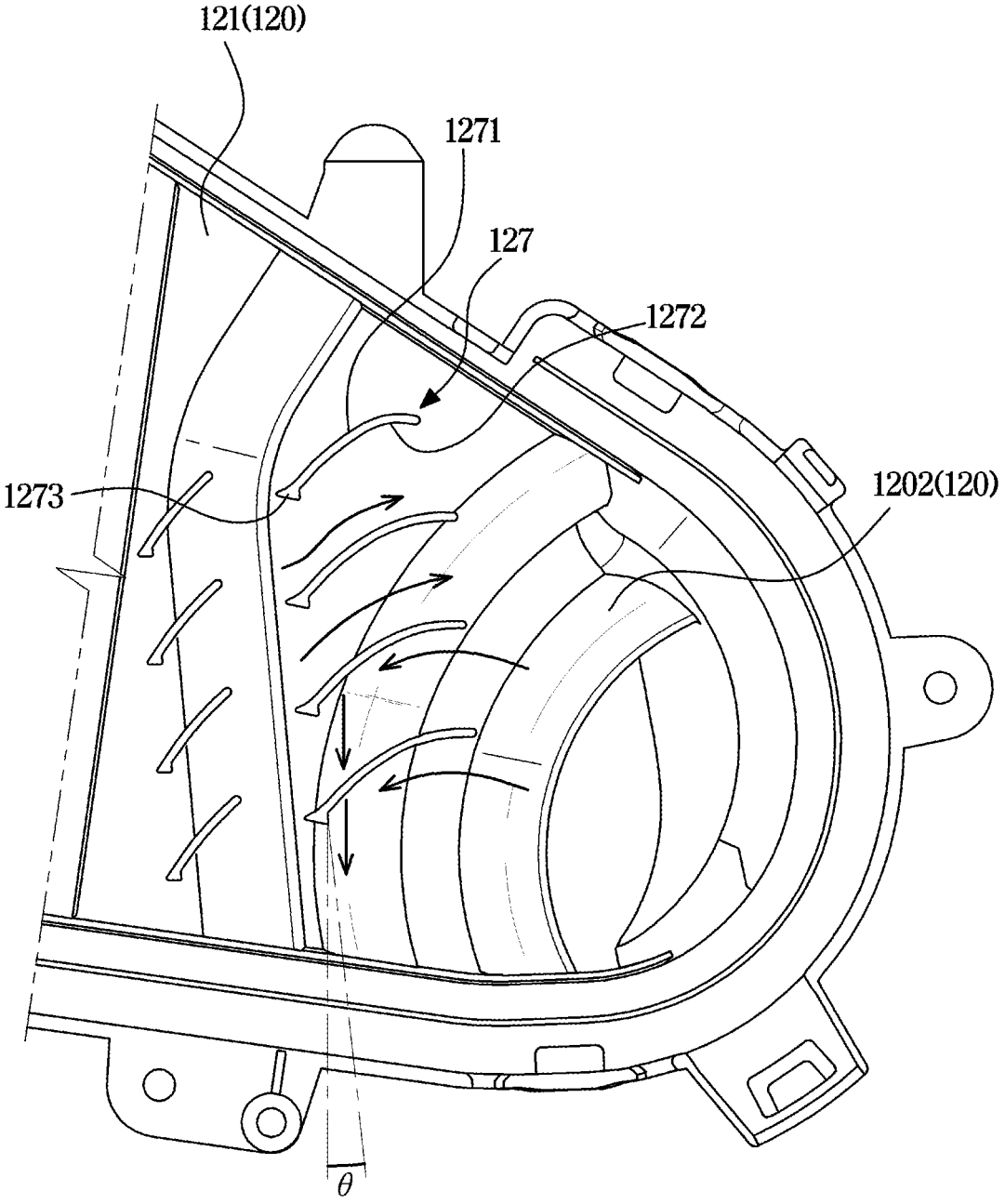
FIG. 17 is an enlarged front view of an area D of FIG. 16.
Figure 18:
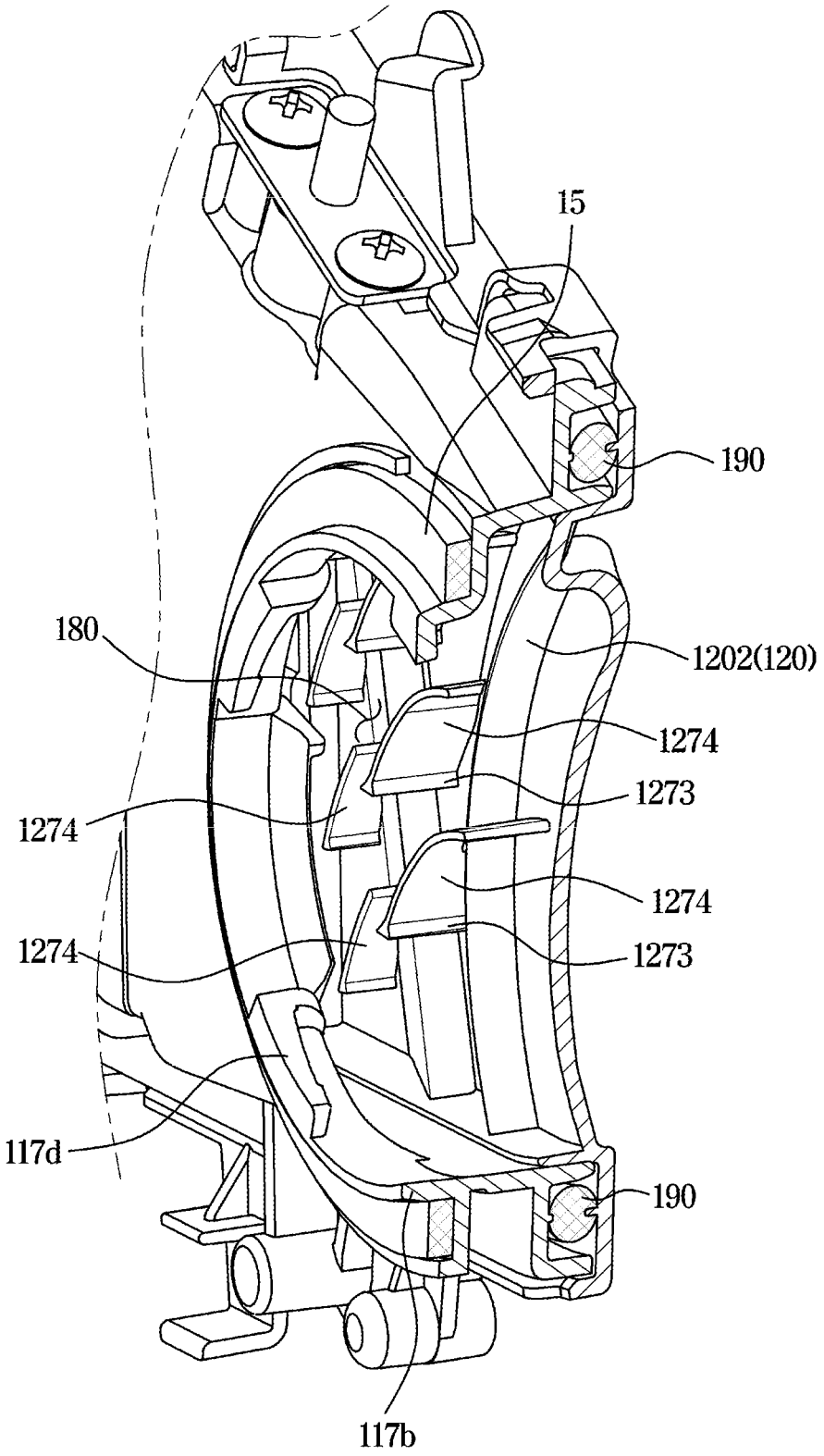
FIG. 18 is a sectional perspective view showing an outlet of a dryer in a dishwasher according to an embodiment of the disclosure.
Figure 19:
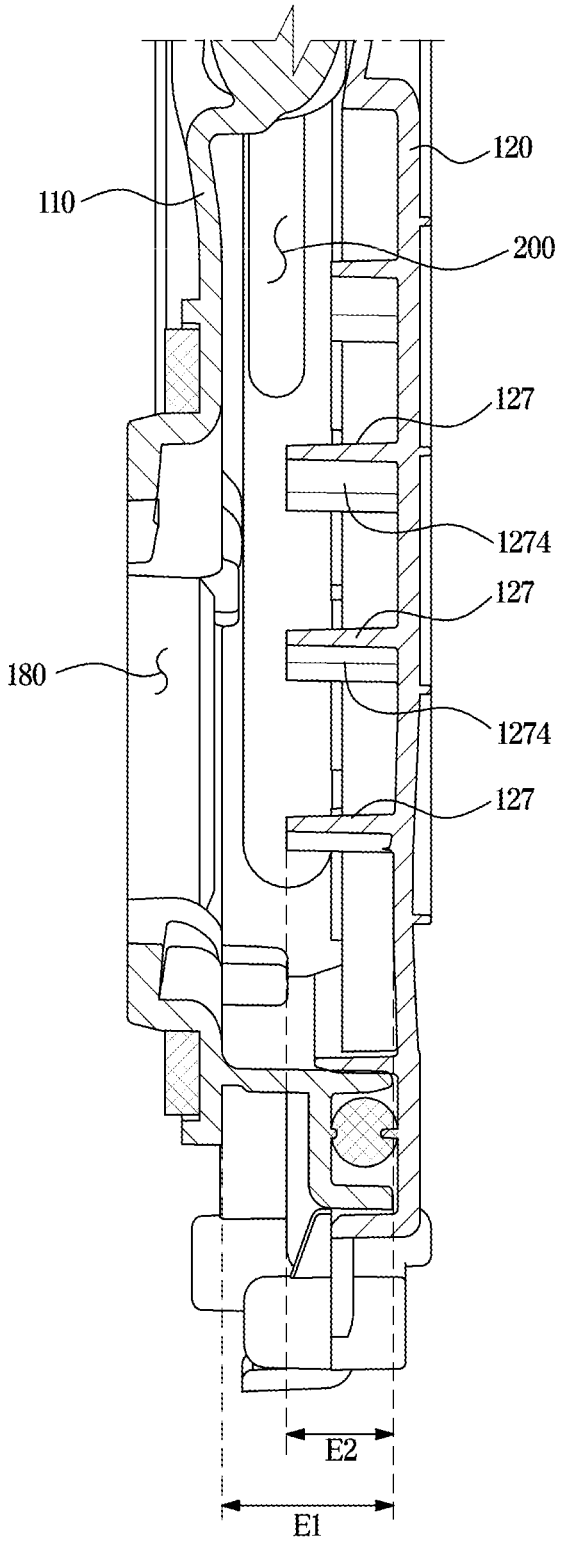
FIG. 19 is a front view of the dryer of FIG. 18.

FIG. 16 shows an inner side of a second housing of the dryer shown in FIG. 6. FIG. 17 is an enlarged front view of an area D of FIG. 16. FIG. 18 is a sectional perspective view showing an outlet of a dryer in a dishwasher according to an embodiment of the disclosure. FIG. 19 is a front view of the dryer of FIG. 18.

Referring to FIGS. 16 to 19, the outlet portion 1202 of the second housing 120 may include a blocking rib 127.

The blocking rib 127 may be formed in the outlet portion 1202 of the second housing 120. More specifically, the blocking rib 127 may be formed downstream of the second heater installing portion 125 of the second housing 120. A plurality of blocking ribs 127 may be provided. However, the number of the blocking ribs 127 is not limited to that shown in the drawings.

The blocking rib 127 may prevent water of the washing room 14 from entering the heater 150 through the outlet 180. The blocking rib 127 may protrude from the inner surface of the second housing 120. More specifically, the blocking rib 127 may extend from the inner surface of the second housing 120 toward the outlet 180.

The blocking rib 127 may include a moving portion 1271.

The moving portion 1271 may extend smoothly upward along a flow direction of a fluid flowing through the flow path 200. The moving portion 1271 may have a curved shape. The moving portion 1271 may be formed on an upper surface of the blocking rib 127.

The moving portion 1271 may have a shape capable of reducing resistance not to interfere with air heated and dried by the heater 150 and then moving toward the outlet 180.

The blocking rib 127 may include a blocking portion 1272.

The blocking portion 1272 may be formed on a lower surface of the blocking rib 127. The blocking portion 1272 may be formed on an opposite surface of the moving portion 1271. The blocking portion 1272 may include a blocking surface 1274 formed on a lower portion of the moving portion 1271 toward the outlet 180.

More specifically, because the outlet 180 is provided in a front portion of the dryer 100, the blocking surface 1274 may be formed toward a front, lower portion of the dryer 100.

The blocking rib 127 may include a blocking protrusion 1273.

The blocking protrusion 1273 may extend downward from one end of the blocking portion 1272. The blocking protrusion 1273 may protrude from the blocking surface 1274. However, the blocking protrusion 1273 may be formed in various shapes.

An angle of a protruding surface of the blocking protrusion 1273 with respect to a reference line in up-down direction of the dishwasher 1 may range from 0 degrees to 90 degrees.

Accordingly, water or a foreign material entered the inside of the dryer 100 through the outlet 180 may be primarily blocked by the blocking portion 1272 of the blocking rib 127. Thereafter, the water or foreign material may move downward along the blocking surface 1274 of the blocking portion 1272 to interfere with the blocking protrusion 1273 and thus fall downward.

The water or foreign material collected in the lower portions of the first housing 110 and the second housing 120 may be naturally discharged to the outlet 180 because the dryer 100 is inclined downward with respect to the front direction.

Accordingly, the water or foreign material entered the outlet 180 may be prevented from reaching the heater 150, etc. positioned more downstream of the second housing 120 than the outlet portion 1202, and accordingly, it may be possible to prevent performance degradation or failure of the dryer 100.

In addition, because the blocking rib 127 is integrated into the second housing 120 and fixed to the second housing 120, there may be no issue that may be caused by a blocking rib moving physically, and the size of the dryer 100 may be reduced.

Also, by forming the blocking rib 127 in a shape that does not interfere with a normal flow of air flowing through the flow path 200, foreign materials may be prevented from entering the dryer 100 and a loss of flow may be reduced.

Referring to FIG. 19, a length E2 of the blocking rib 127 protruding from the inner surface of the second housing 120 may be shorter than a length E1 by which the inner surface of the second housing 120 is spaced from the inner surface of the first housing 110.

In other words, the length E2 of the blocking rib 127 protruding from the inner surface of the second housing 120 may be the same as a width E2 of the blocking surface 1274. Also, the length E1 by which the inner surface of the second housing 120 is spaced from the inner surface of the first housing 110 may be the same as a width E1 of the flow path 200.

Accordingly, the width E1 of the blocking surface 1274 may be smaller than the width E1 of the flow path 200. That is, because the blocking rib 127 does not completely close the flow path 200 in a width direction of the flow path 200, a loss of flow of air may be reduced.

According to the disclosure, by extending the dryer along the front-rear direction of the tub, an installation limitation of the dryer according to a height of the tub may be reduced.

Also, by positioning the switch module between the first housing and the second housing of the dryer, an area of the flow path formed inside the first housing and the second housing may be widened.

Also, by reducing a difference in height between the inlet and the outlet of the dryer, interference of air circulation by dishes accommodated in the baskets may be reduced.

Also, by fixing the switch module to the first housing and the second housing without a separate coupling member, an assembly process may be simplified.

Also, by forming the blocking rib inside the housing, it may be possible to prevent water or foreign materials from entering the inside of the dryer through the outlet to cause failure.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. A dishwasher comprising:

a tub including a washing room formed therein; and a dryer installed on an outer side of the tub and communicating with the washing room, the dryer comprising:

a housing having an inlet through which air enters the dryer and an outlet through which the air is discharged from the dryer, the housing comprising:

a first housing having one side coupled with the outer side of the tub; and a second housing coupled with an other side of the first housing, and forming a flow path together with the first housing, between the first housing and the second housing;

a fan accommodated inside the first housing and the second housing and configured to guide air flow along the flow path, the fan positioned downstream of the inlet;

a heater configured to heat the air passing through the flow path; and a switch module coupled to the housing and comprising a switch configured to turn off the heater based on a temperature of the flow path, the switch comprising:

a terminal disposed outside the housing and electrically connected with the heater;

a sensor protruding to an inside of the housing and adjacent to the heater, the sensor configured to detect the temperature of the flow path;

a fixing portion fixed to the housing; and a switching portion configured to turn off the heater in response to the temperature of the flow path detected by the sensor reaching a preset temperature.

2. The dishwasher of claim 1, further comprising a plurality of baskets to be positioned at different heights inside the washing room and being withdrawable in a front direction, wherein the one side of the tub is an outer side of the tub, and the dryer is installed on the outer side of the tub, and the inlet and the outlet of the dryer are positioned between the plurality of baskets.

3. The dishwasher of claim 1, wherein the first housing comprises:

a first housing body positioned side by side with the one side of the tub; and a first side flange bent from the first housing body, extending toward the second housing, and including a first switch installing portion in which the switch module is accommodated, and the second housing comprises:

a second housing body facing the first housing body; and a second side flange bent from the second housing body, extending toward the first housing, and including a second switch installing portion in which the switch module is accommodated.

4. The dishwasher of claim 3, wherein the first housing further comprises a first support rib protruding from an inner surface of the first housing body and supporting the switch module from below, and the second housing further comprises a second support rib protruding from an inner surface of the second housing body and supporting the switch module from below.

5. The dishwasher of claim 4, wherein the switch module is fixed by being positioned on an upper surface of the first support rib and an upper surface of the second support rib and between the first switch installing portion and the second switch installing portion.

6. The dishwasher of claim 4, wherein each of the first support rib and the second support rib comprises a chamfer portion formed on an upper surface of the each of the first support rib and the second support rib and inclined downward toward an end of the each of the first support rib and the second support rib.

7. The dishwasher of claim 1, wherein the switch module further comprises:

a holder supported by the first housing and the second housing, the holder accommodating a portion of the switch; and a sealing member positioned between the switch and the holder and sealing the flow path.

8. The dishwasher of claim 7, wherein the terminal passes through the sealing member, wherein the sensor passes through the holder, and wherein the fixing portion extends from the sensor to be positioned side by side with the holder, and is accommodated between the sealing member and the holder.

9. The dishwasher of claim 1, wherein the second housing comprises a blocking rib formed downstream of the heater and preventing water of the washing room from entering the heater through the outlet, the blocking rib protruding from an inner surface of the second housing.

10. The dishwasher of claim 9, wherein the blocking rib comprises:

a moving portion extending upward and curved along a flow direction of a fluid flowing through the flow path;

a blocking portion including a blocking surface formed on a lower portion of the moving portion toward the outlet; and a blocking protrusion extending downward from one end of the blocking portion.

11. The dishwasher of claim 9, wherein a length of the blocking rib protruding from the inner surface of the second housing is shorter than a length between the inner surface of the second housing and the inner surface of the first housing.

12. The dishwasher of claim 1, further comprising a cabinet positioned outside the tub, wherein the dryer is installed in a space formed between the tub and the cabinet, and a portion of the switch module is positioned between the tub and the cabinet and exposed upward from the dryer.

13. The dishwasher of claim 12, wherein the switch module is electrically connected with the heater through the portion of the switch module which is exposed.

14. The dishwasher of claim 1, wherein the first housing and the second housing extend in a front-rear direction of the tub, and inclined downward with respect to a front direction of the dishwasher to discharge water collected inside the first housing and the second housing.

15. A dishwasher comprises:

a tub including a washing room formed therein;

a door to open or close the washing room; and a dryer installed on an outer side of the tub, the dryer comprising:

a housing having a flow path formed therein, an inlet formed one side of the housing and facing the outer side of the tub, and through which air enters the dryer;

a fan accommodated inside the housing and configured to guide air flow along the flow path, the fan positioned downstream of the inlet;

a heater configured to heat the air entered the dryer through the inlet;

an outlet, formed an other side of the housing and facing the outer side of the tub, and through which the air heated by the heater is discharged from the dryer; and a switch module coupled to the housing and comprising a switch configured to turn off the heater based on a temperature of the flow path, the switch comprising:

a terminal disposed outside the housing and electrically connected with the heater;

a sensor protruding to an inside of the housing and adjacent to the heater, the sensor configured to detect the temperature of the flow path;

a fixing portion fixed to the housing; and a switching portion configured to turn off the heater in response to the temperature of the flow path detected by the sensor reaching a preset temperature, wherein the housing is installed on the tub along a front-rear direction of the tub such that the outlet is closer to the door than the inlet.

16. The dishwasher of claim 15, further comprising a plurality of baskets to be positioned at different heights inside the washing room and being withdrawable in a front direction of the dishwasher, and the dryer is installed on an outer side of the tub, and the inlet and the outlet of the dryer are positioned between the plurality of baskets.

17. The dishwasher of claim 15, wherein the housing comprises:

a first housing coupled with the tub and communicating with the washing room; and a second housing forming the flow path together with the first housing and positioned on an outer side of the first housing so that inside air of the washing room circulates back to the washing room by passing through the flow path, and wherein the switch module is installed between the first housing and the second housing, and wherein the heater is accommodated inside the first housing and the second housing.

18. A dishwasher comprises:

a cabinet;

a tub inside the cabinet and forming a washing room therein; and a dryer between the cabinet and the tub, and configured to heat air inside of the washing room, the dryer comprising:

a housing having an inlet through which air enters the dryer and an outlet through which the air is discharged from the dryer, the housing comprising:

a first housing coupled with a side wall of the tub; and a second housing coupled with the first housing and forming a flow path together with the first housing, between the first housing and the second housing;

a fan accommodated inside the first housing and the second housing and configured to guide air flow along the flow path, the fan positioned downstream of the inlet;

a heater installed between the first housing and the second housing to heat the air passing through the flow path; and a switch module supported by the housing and comprising a switch configured to turn off the heater based on a temperature of the flow path, the switch module comprising:

a terminal disposed outside the housing and electrically connected with the heater;

a sensor protruding to an inside of the housing and adjacent to the heater, the sensor configured to detect the temperature of the flow path;

a fixing portion fixed to the housing; and a switching portion configured to turn off the heater in response to the temperature of the flow path detected by the sensor reaching a preset temperature, wherein a portion of the switch module is exposed to a space formed between the tub and the cabinet, and electrically connected with the heater through the portion of the switch module which is exposed.

19. The dishwasher of claim 18, wherein a lower surface of the switch module is supported by a first support rib and a second support rib positioned upstream of the heater, protruding toward the flow path, and extending respectively from inner surfaces of the first housing and the second housing.

* * * * *